US011505761B2

(12) United States Patent
Gooding et al.

(10) Patent No.: US 11,505,761 B2
(45) Date of Patent: Nov. 22, 2022

(54) DILUENT OILS FOR VISCOSITY MODIFIERS AND ADDITIVE PACKAGES

(71) Applicant: ExxonMobil Technology and Engineering Company, Annandale, NJ (US)

(72) Inventors: Beatrice M. Gooding, Hopewell, NJ (US); Akhilesh Duggal, Magnolia, TX (US); Toufic Aridi, Sarnia (CA); Samantha Novoa, Sarnia (CA); Lauren F. McKibben, Sarnia (CA); Charles L. Baker, Jr., Thornton, PA (US)

(73) Assignee: Exxon Mobil Technology and Engineering Company, Annandale, NJ (US)

( * ) Notice: Subject to any disclaimer, the term of this patent is extended or adjusted under 35 U.S.C. 154(b) by 0 days.

(21) Appl. No.: 17/474,937

(22) Filed: Sep. 14, 2021

(65) Prior Publication Data

US 2022/0081641 A1 Mar. 17, 2022

Related U.S. Application Data

(60) Provisional application No. 63/079,494, filed on Sep. 17, 2020.

(51) Int. Cl.
*C10M 171/02* (2006.01)
*C10M 169/04* (2006.01)
(Continued)

(52) U.S. Cl.
CPC ..... *C10M 171/02* (2013.01); *C10M 143/04* (2013.01); *C10M 169/041* (2013.01);
(Continued)

(58) Field of Classification Search
CPC ..... C10M 171/02; C10M 143/04; C10M 169/041; C10M 2203/1006; C10M 2205/024; C10N 2020/02; C10N 2030/02
See application file for complete search history.

(56) References Cited

U.S. PATENT DOCUMENTS 1,815,022 A 7/1931 Davis
2,015,748 A 10/1935 Frolich
(Continued)

FOREIGN PATENT DOCUMENTS

WO 1998013443 A1 4/1998
WO 1999021902 A1 5/1999

OTHER PUBLICATIONS

Gaylord et al, "Peroxide-Catalyzed Grafting of Maleic Anhydride onto Molten Polyethylene in the Presence of Polar Drganic Compounds", Journal of Polymer Science: Part A: Polymer Chemistry, vol. 26, pp. 1189-1198 (1988), John Wiley & Sons, Inc.
(Continued)

*Primary Examiner* — Ellen M McAvoy
(74) *Attorney, Agent, or Firm* — Scott F. Yarnell; C. Tumey Law Group PLLC

(57) ABSTRACT

Embodiments of the present disclosure generally relate to diluent oils for viscosity modifiers and additive packages. Embodiments of the present disclosure also generally relate to lubricating oil compositions that include viscosity modifier concentrates and lubricating oil compositions that include additive package concentrates. Improved diluent oils capable of conveniently and cost effectively improving overall lubricant performance are provided.

31 Claims, 4 Drawing Sheets

(51) Int. Cl.
*C10M 143/04* (2006.01)
*C10N 20/02* (2006.01)
*C10N 30/02* (2006.01)

(52) U.S. Cl.
CPC ..... *C10M 2203/1006* (2013.01); *C10M 2205/024* (2013.01); *C10N 2020/02* (2013.01); *C10N 2030/02* (2013.01)

(56) References Cited

U.S. PATENT DOCUMENTS 2,191,498 A 2/1940 Reiff
2,387,501 A 10/1945 Dietrich
2,655,479 A 10/1953 Munday et al.
2,666,746 A 1/1954 Munday et al.
2,721,877 A 10/1955 Popkin et al.
2,721,878 A 10/1955 Popkin
3,113,986 A 12/1963 Breslow et al.
3,250,715 A 5/1966 Wyman
3,595,791 A 7/1971 Cohen
3,634,595 A 1/1972 Pasquali
3,670,054 A 6/1972 De La Mare et al.
3,700,633 A 10/1972 Wald et al.
4,146,489 A 3/1979 Stambaugh et al.
4,266,945 A 5/1981 Karn
4,292,414 A 9/1981 Saito et al.
4,529,526 A 7/1985 Inoue et al.
4,798,684 A 1/1989 Salomon
5,084,197 A 1/1992 Galic et al.
5,141,996 A 8/1992 Zon et al.
5,427,702 A * 6/1995 Chung ..... C10M 145/16 508/232
6,034,039 A 3/2000 Gomes et al.
7,018,962 B2 3/2006 Bloch et al.
7,704,930 B2 4/2010 Plut
3,048,833 A1 11/2011 Habeeb et al.
2004/0214731 A1 10/2004 Tynik
2006/0205610 A1* 9/2006 Rosenbaum ..... C10G 2/32 208/18
2006/0281647 A1* 12/2006 Hazelton ..... C10M 149/04 508/591
2007/0042917 A1 2/2007 Ravichandran et al.
2009/0005274 A1* 1/2009 Swartele ..... C10M 177/00 508/110
2009/0156442 A1* 6/2009 Chambard ..... C10M 157/00 508/306
2015/0184105 A1* 7/2015 Taribagil ..... C10M 169/04 508/591
2015/0184108 A1* 7/2015 Taribagil ..... C10M 169/041 508/591
2018/0171258 A1* 6/2018 Pirouz ..... C08F 8/32
2020/0407474 A1* 12/2020 Zhang ..... C10M 143/14
2021/0040250 A1* 2/2021 Zhang ..... C08F 210/06

OTHER PUBLICATIONS

Gaylord et al, "Role of Homopolymerization In the Peroxide Catalyzed Reaction of Maleic Anhydride and Polyethylene in the Absence of Solvent", Journal of Polymer Science: Polymer Letters Edition, vol. 20, pp. 481-486 (1982), John Wiley & Sons, Inc.
Gaylord et al, "Nondegradative Reaction of Maleic Anhydride and Molten Polypropylene in the Presence of Peroxides", Journal of Polymer Science: Polymer Letters Edition, vol. 21, pp. 23-30 (1983), John Wiley & Sons, Inc.
Gaylord et al, "Degradation and Cross-linking of Ethylene-Propylene Copolymer Rubber on Reaction With Maleic Anhydride and/or Peroxides", Journal of Applied Polymer Science, vol. 33, pp. 2549-2558 (1987), John Wiley & Sons, Inc.

* cited by examiner

DILUENT OILS FOR VISCOSITY MODIFIERS AND ADDITIVE PACKAGES

CROSS-REFERENCE TO RELATED APPLICATIONS

This application claims the benefit of U.S. Provisional Application No. 63/079,494, filed on Sep. 17, 2020, the entire contents of which are incorporated herein by reference.

FIELD OF THE INVENTION

Embodiments of the present disclosure generally relate to diluent oils for viscosity modifiers and additive packages. Embodiments of the present disclosure also generally relate to lubricating oil compositions that include viscosity modifier concentrates and lubricating oil compositions that include additive package concentrates.

BACKGROUND

Lubricating oils contain various components including base oils, diluent oils, and additives that enhance the performance of the lubricant. The additives are formulated into packages, e.g., concentrates, for specified end-use applications such as automotive engine crankcase lubricants, hydraulic fluids, and gear oils. The concentrates, such as viscosity modifier concentrates and additive package concentrates, include a diluent oil and one or more additives.

Viscosity modifiers, also known as viscosity index improvers (VI improvers) or viscosity improvers, are additives that improve the viscometric performance of the oil by, e.g., decreasing the base oil viscosity temperature dependency, reducing lubricating oil resistance to cold engine starting (as measured by "cold crank simulator (CCS)" performance), and reducing the viscosity of the oils in response to shear. The viscosity modifiers typically consist of polymers, such as long-chain, high molecular weight polymers. Viscosity modifiers are typically provided to lubricating oil formulators as a concentrate in which the viscosity modifier polymer is diluted in a diluent oil to allow for easier dissolution of the viscosity modifier in the base oil. Although much effort has been made to select the proper base oil for finished lubricant formulations, little attention has been given to the selection of the diluent oil used to form the viscosity modifier concentrate.

Typically, the lubricating oil formulator needs to add a quantity of relatively high quality base oil, as a correction fluid, to ensure the formulation viscosities, e.g., kinematic and CCS, remains within specification. Because the viscosity modifier and the base oil, e.g., Group III base oil, contribute significantly to the cost of the finished lubricating oil, lowering treat rates to meet target viscosities of the finished lubricating oil and minimizing the amount of base oil used in the finished lubricating oil would lower the cost of the lubricating oil.

Diluent oils for additive packages can also be selected based on certain compositional constraints such as solvency and oxidation stability. However, achieving enhanced solvency and improved oxidation stability remains a challenge. Current commercial practices typically involve the use of base oils-such as Group I and Group II base oils-as diluent oils for additive packages. These and other base oils, however, are limited in terms of solvency and oxidation stability.

For example, these base oils can have improved solubility but at the expense of oxidation stability and vice versa.

SUMMARY

Embodiments of the present disclosure generally relate to diluent oils for viscosity modifiers and additive packages. Embodiments of the present disclosure also generally relate to lubricating oil compositions that include viscosity modifier concentrates and lubricating oil compositions that include additive package concentrates.

In an embodiment, a method of forming a viscosity modifier concentrate is provided. In this embodiment, the method includes selecting a viscosity modifier for the viscosity modifier concentrate and selecting a diluent oil to combine with the viscosity modifier based on the equation:

$$KV100_{VMC}=(130.3*KV100_{DO})-4.5*\text{aniline point}_{DO})+532.$$

In this embodiment, the method further includes introducing the viscosity modifier to the diluent oil to form the viscosity modifier concentrate, wherein: $KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline $\text{point}_{DO}$ is the aniline point of the diluent oil as measured according to ASTM D611, the aniline $\text{point}_{DO}$ being from about 95° C. to about 130° C.

In another embodiment, a viscosity modifier concentrate is provided. In this embodiment, the viscosity modifier concentrate includes a viscosity modifier and a diluent oil. The diluent oil of this embodiment is characterized by the equation:

$$KV100_{VMC}=(130.3*KV100_{DO})-(4.5*\text{aniline point}_{DO})+532,$$

wherein: $KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline $\text{point}_{DO}$ is the aniline point of the diluent oil as measured according to ASTM D611, the aniline $\text{point}_{DO}$ being from about 95° C. to about 130° C.

In another embodiment, a method of forming a lubricating oil composition is provided. In this embodiment, the method includes selecting a viscosity modifier for a viscosity modifier concentrate and selecting a diluent oil to combine with the viscosity modifier based on the equation:

$$KV100_{VMC}=(130.3*KV100_{DO})-(4.5*\text{aniline point}_{DO})+532.$$

In this embodiment, the method further includes introducing the viscosity modifier to the diluent oil to form the viscosity modifier concentrate, and introducing a base oil to the viscosity modifier concentrate to form the lubricating oil composition, the base oil being the same or different than the diluent oil. $KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline $\text{point}_{DO}$ is the aniline point of the diluent oil as measured according to ASTM D611, the aniline point$_{DO}$ being from about 95° C. to about 130° C.

In another embodiment, a method of forming an additive package concentrate is provided. In this embodiment, the method includes selecting one or more additives for the additive package concentrate, and selecting a diluent oil to combine with the one or more additives based on the equations:

$$\text{aniline point}_{DO}=105.694-(0.01507*\text{total aromatics}_{DO})-(11.21*\text{aliphatic sulfur}_{DO})+(0.15469*\text{KV40}_{DO}),\text{ and}$$

$$\text{TOST}_{DO}=4626-(10202*(2+\text{ring aromatics}_{DO}/\text{total aromatics}_{DO}))+(2065*\text{aliphatic sulfur}_{DO}).$$

In this embodiment, the method further includes introducing the one or more additives to the diluent oil to form the additive package concentrate. Aniline point$_{DO}$ is the aniline point of the diluent oil in units of ° C., the aniline point$_{DO}$ being from about from 95° C. to 120° C., TOST$_{DO}$ is the turbine oil oxidation stability test value of the diluent oil in units of hours, the TOST$_{DO}$ being from about 1350 hours to about 3950 hours, the aliphatic sulfur$_{DO}$ is the amount (wt %) of aliphatic sulfur in the diluent oil, the KV40$_{DO}$ is the kinematic viscosity (cSt) at 40° C. of the diluent oil as measured according to ASTM D445, the total aromatics$_{DO}$ is the amount (mmol/kg) of 1+ring aromatics in the diluent oil as measured according to ASTM D7419, and the 2+ring aromatics$_{DO}$ is the amount (mmol/kg) of 2+ring aromatics in the diluent oil.

In another embodiment, an additive package concentrate is provided. In this embodiment, the additive package concentrate includes one or more additives and a diluent oil. In this embodiment, the diluent oil is characterized by the equations:

$$\text{aniline point}_{DO}=105.694-(0.01507*\text{total aromatics}_{DO})-(11.21*\text{aliphatic sulfur}_{DO})+(0.15469*\text{KV40}_{DO}),\text{ and}$$

$$\text{TOST}_{DO}=4626-(10202*(2+\text{ring aromatics}_{DO}/\text{total aromatics}_{DO}))+(2065*\text{aliphatic sulfur}_{DO}),$$

wherein: aniline point$_{DO}$ is the aniline point of the diluent oil in units of ° C., the aniline point$_{DO}$ being from about from 95° C. to 120° C., TOST$_{DO}$ is the turbine oil oxidation stability test value of the diluent oil in units of hours, the TOST$_{DO}$ being from about 1350 hours to about 3950 hours, the aliphatic sulfur$_{DO}$ is the amount (wt %) of aliphatic sulfur in the diluent oil, the KV40$_{DO}$ is the kinematic viscosity (cSt) at 40° C. of the diluent oil as measured according to ASTM D445, the total aromatics$_{DO}$ is the amount (mmol/kg) of 1+ring aromatics in the diluent oil as measured according to ASTM D7419, and the 2+ring aromatics$_{DO}$ is the amount (mmol/kg) of 2+ring aromatics in the diluent oil.

In another embodiment, a method of forming a lubricating oil composition is provided. In this embodiment, the method includes selecting one or more additives for an additive package concentrate, and selecting a diluent oil to combine with the one or more additives based on the equations:

$$\text{aniline point}_{DO}=105.694-(0.01507*\text{total aromatics}_{DO})-(11.21*\text{aliphatic sulfur}_{DO})+(0.15469*\text{KV40}_{DO}),\text{ and}$$

$$\text{TOST}_{DO}=4626-(10202*(2+\text{ring aromatics}_{DO}/\text{total aromatics}_{DO}))+(2065*\text{aliphatic sulfur}_{DO}).$$

The method of this embodiment further includes introducing the one or more additives to the diluent oil to form the additive package concentrate, and introducing a base oil to the additive package concentrate to form the lubricating oil composition, the base oil being the same or different than the diluent oil. Aniline point$_{DO}$ is the aniline point of the diluent oil in units of ° C., the aniline point$_{DO}$ being from about from 95° C. to 120° C., TOST$_{DO}$ is the turbine oil oxidation stability test value of the diluent oil in units of hours, the TOST$_{DO}$ being from about 1350 hours to about 3950 hours, the aliphatic sulfur$_{DO}$ is the amount (wt %) of aliphatic sulfur in the diluent oil, the KV40$_{DO}$ is the kinematic viscosity (cSt) at 40° C. of the diluent oil as measured according to ASTM D445, the total aromatics$_{DO}$ is the amount (mmol/kg) of 1+ring aromatics in the diluent oil as measured according to ASTM D7419, and the 2+ring aromatics$_{DO}$ is the amount (mmol/kg) of 2+ring aromatics in the diluent oil.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
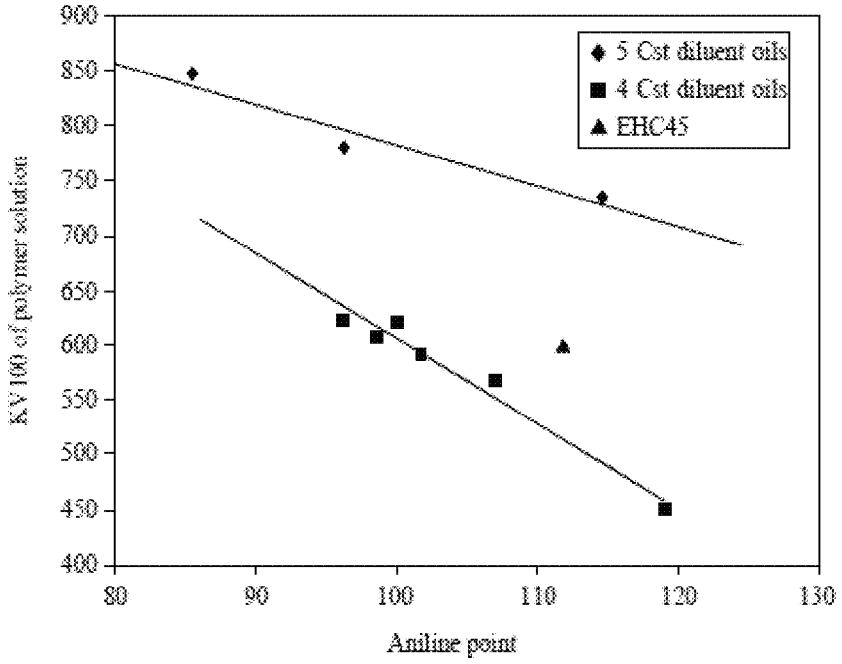
FIG. 1A is a plot of kinematic viscosity at 100° C. (KV100) versus aniline point of example viscosity modifier concentrates according to at least one embodiment of the present disclosure.

Improved diluent oils that are unexpectedly capable of conveniently and cost effectively improving overall lubricant performance are described below. Viscosity modifier concentrates containing the improved diluent oils unexpectedly provide improved viscometric performance while reducing treat rates and the amount of base oil in the finished lubricating oil are described below. Moreover, additive packages containing the improved diluent oils unexpectedly provide enhanced solvency and oxidative stability. Thus, embodiments of the present disclosure generally relate to diluent oils for viscosity modifiers and additive packages.

Embodiments of the present disclosure also generally relate to lubricating oil compositions that include viscosity modifier concentrates and lubricating oil compositions that include additive package concentrates.

Diluent oils tend to be a minor component in a finished lubricant formulation. For example, a lubricant (e.g., engine oil, hydraulic oil) typically contains many additives. The diluent oil is generally in the finished lubricant formulation as a "carrier fluid" to reduce the high viscosity additive(s) to a low enough viscosity to enable blending the additives as liquids. The diluent oil is also there to help solubilize the additives and to keep the additives oxidatively stable. Although much effort has been made to select the properbase oil for lubricants, little attention has been given to the selection of the diluent oil used in viscosity modifier concentrates as well as diluent oils used in additive packages.

In at least one embodiment, the present disclosure provides a method of forming a viscosity modifier concentrate having an improved diluent oil. The diluent oils, and the methods of making diluent oils, of the present disclosure are able to solvate viscosity modifiers and other additives. The inventors have unexpectedly found that the properties of the concentrates (diluent oils with the viscosity modifiers and/or additives), such as kinematic viscosity, can carry over to the finished lubricant formulation. This is surprising for at least the reason that the concentrates are relatively minor components of the finished lubricant formulation. Typically, it would be expected that the material used to sufficiently dissolve the polymer, being used in minor amounts, should have little bearing on the properties of the final formulation. However, the inventors found that there is an unexpected nature of the composition of these improved diluent oils disclosed herein that affects the effective use of the viscosity modifiers, e.g., high molecular weight polymers, and/or other additives. In addition, the additive package concentrates and lubricant compositions comprising such concentrates show an unexpected improvement in solvency and oxidative stability.

For the purposes of this disclosure, and unless otherwise specified, all numerical values within the detailed description and the claims herein are modified by "about" or "approximately" the indicated value, and consider experimental error and variations that would be expected by a person having ordinary skill in the art.

For the purposes of this disclosure, viscosity modifiers, viscosity index (VI) improvers, and viscosity improvers are used interchangeably.

For purposes of this disclosure, and unless otherwise indicated, a "composition" includes components of the composition and/or reaction products of two or more components of the composition.

I. Viscosity Modifier Concentrates and Lubricating Oil Compositions Including Such The present disclosure generally relates to viscosity modifier concentrates, to methods of making viscosity modifier concentrates, to lubricating oil compositions comprising viscosity modifier concentrates, and to methods of making lubricating oil compositions.

Viscosity modifiers (VM) are finished lubricant additives that decrease base oil viscosity temperature dependency. They typically consist of a long chain, high molecular weight polymer dissolved in abase oil. Viscosity modifiers are typically high molecular weight polymers, e.g., up to about 250,000 g/mol or more, and relatively nonpolar. Due to such properties of the viscosity modifiers, they can be very difficult to dissolve, particularly when the base oil has a molecular weight around 5,000 g/mol. The majority of viscosity modifier concentrate preparations use diluent oils that meet traditional API Group I or Group II classification criteria. Dissolving viscosity modifiers is a difficult task that typically requires significant quantities of diluent oil. At the same time, it can be important to maximize the diluent oil solvency to enhance the viscosity modifier effect in the finished lubricant while not impacting other properties. The inventors have unexpectedly found that the solvency effects observed when making viscosity modifier concentrates can be preserved in the finished lubricant. Based on at least these unexpected and surprising observations, certain selection criteria can be used to enhance diluent oils used for viscosity modifier concentrates. Such selection criteria can enable the targeting of specific properties by, e.g., adjusting manufacturing processes and/or blending existing oils. Moreover, and in some examples, embodiments of the present disclosure can enable a lower-cost engine oil formulation by, e.g., reducing viscosity modifier treat rate and Group III content.

In at least one embodiment, the viscosity modifier concentrate includes a diluent oil and a viscosity modifier. The viscosity modifier concentrate can include more than one viscosity modifier in any proportion and/or more than one diluent oil in any proportion. Illustrative, non-limiting examples of viscosity modifiers and diluent oils useful for the viscosity modifier concentrates are provided below.

In at least one embodiment, a method of forming a viscosity modifier concentrate can include selecting a viscosity modifier for the viscosity modifier concentrate; selecting a diluent oil to combine with the viscosity modifier based on Equation 1; and introducing the viscosity modifier to the diluent oil to form the viscosity modifier concentrate.

$$KV100_{VMC}=(130.3*KV100_{DO})-(4.5*\text{aniline point}_{DO})+532 \quad \text{(Eq. 1)}$$

In Equation 1, $KV100_{VMC}$ is the kinematic viscosity at 100° C. of the viscosity modifier concentrate in units of cSt, $KV100_{DO}$ is the kinematic viscosity at 100° C. of the diluent oil as measured according to ASTM D445, and aniline $point_{DO}$ is the aniline point of the diluent oil as measured according to ASTM D611.

In some embodiments, the $KV100_{VMC}$ is from about 400 cSt to about 2500 cSt, the $KV100_{DO}$ is from about 3.9 cSt to about 5.5 cSt, and/or the aniline $point_{DO}$ is from about 95° C. to about 130° C.

In some embodiments, the KV100 of the viscosity modifier concentrate ($KV100_{VMC}$) can be about 300 cSt or more and/or about 3,000 cSt or less, such as from about 400 cSt to about 2500 cSt. In at least one embodiment the $KV100_{VMC}$ (in units of cSt) can range from $KV100_{VMC1}$ to $KV100_{VMC2}$, where each of $KV100_{VMC1}$ and $KV100_{VMC2}$ is independently about 400, about 410, about 420, about 430, about 440, about 450, about 460, about 470, about 480, about 490, about 500, about 510, about 520, about 530, about 540, about 550, about 560, about 570, about 580, about 590, about 600, about 610, about 620, about 630, about 640, about 650, about 660, about 670, about 680, about 690, about 700, about 710, about 720, about 730, about 740, about 750, about 760, about 770, about 780, about 790, about 800, about 810, about 820, about 830, about 840, about 850, about 860, about 870, about 880, about 890, about 900, 910, about 920, about 930, about 940, about 950, about 960, about 970, about 980, about 990, about 1000, 1010, about 1020, about 1030, about 1040, about 1050, about 1060, about 1070, about 1080, about 1090, about 1100, 1110, about 1120, about 1130, about 1140, about 1150, about 1160, about 1170, about 1180, about 1190, about 1200, 1210, about 1220, about 1230, about 1240, about 1250, about 1260, about 1270, about 1280, about 1290, about 1300, 1310, about 1320, about 1330, about 1340, about 1350, about 1360, about 1370, about 1380, about 1390, about 1400, 1410, about 1420, about 1430, about 1440, about 1450, about 1460, about 1470, about 1480, about 1490, about 1500, 1510, about 1520, about 1530, about 1540, about 1550, about 1560, about 1570, about 1580, about 1590, about 1600, 1610, about 1620, about 1630, about 1640, about 1650, about 1660, about 1670, about 1680, about 1690, about 1700, 1710, about 1720, about 1730, about 1740, about 1750, about 1760, about 1770, about 1780, about 1790, about 1800, 1810, about 1820, about 1830, about 1840, about 1850, about 1860, about 1870, about 1880, about 1890, about 1900, 1910, about 1920, about 1930, about 1940, about 1950, about 1960, about 1970, about 1980, about 1990, about 2000, 2010, about 2020, about 2030, about 2040, about 2050, about 2060, about 2070, about 2080, about 2090, about 2100, 2110, about 2120, about 2130, about 2140, about 2150, about 2160, about 2170, about 2180, about 2190, about 2200, 2210, about 2220, about 2230, about 2240, about 2250, about 2260, about 2270, about 2280, about 2290, about 2300, 2310, about 2320, about 2330, about 2340, about 2350, about 2360, about 2370, about 2380, about 2390, about 2400, 2410, about 2420, about 2430, about 2440, about 2450, about 2460, about 2470, about 2480, about 2490, or about 2500 cSt, so long as $KV100_{VMC2}>KV100_{VMC1}$.

In some embodiments, the KV100 (ASTM D445) of the diluent oil ($KV100_{DO}$) can be from about 2 cSt to about 10 cSt. In at least one embodiment the $KV100_{DO}$ (in units of cSt) can range from $KV100_{DO1}$ to $KV100_{DO2}$, where each of $KV100_{DO1}$ and $KV100_{DO2}$ is independently about 2, about 3, about 4, about 5, about 6, about 7, about 8, about 9, or about 10 cSt, so long as $KV100_{DO2}>KV100_{DO1}$.

In some embodiments, the aniline point of the diluent oil (aniline $point_{DO}$) can be about 50° C. or more and/or about 150° C. or less, such as from about 95° C. to about 130° C., as measured according to ASTM D611. In at least one embodiment, the aniline $point_{DO}$ (in units of ° C.) can range from aniline $point_{DO1}$ to aniline $point_{DO2}$, where each of aniline $point_{DO1}$ and aniline $point_{DO2}$ is independently about 95, about 96, about 97, about 98, about 99, about 100, about 101, about 102, about 103, about 104, about 105, about 106, about 107, about 108, about 109, about 110, about 111, about 112, about 113, about 114, about 115, about 116, about 117, about 118, about 119, about 120, about 121, about 122, about 123, about 124, about 125, about 126, about 127, about 128, about 129, or about 130, so long as aniline $point_{DO2}>$aniline $point_{DO1}$.

In at least one embodiment, the $KV40_{DO}$ (ASTM D445) can be from about 15 cSt to about 40 cSt. In some embodiments, the $KV40_{DO}$ (in units of cSt) can range from $KV40_{DO1}$ to $KV40_{DO2}$, where each of $KV40_{DO1}$ and $KV40_{DO2}$ is independently about 15, about 16 m about 17, about 18, about 19, about 20, about 21, about 22, about 23, about 24, about 25, about 26, about 27, about 28, about 29, about 30, about 31, about 32, about 33, about 34, about 35, about 36, about 37, about 38, about 39, or about 40, so long as $KV40_{DO2}>KV40_{DO1}$.

In some embodiments, the diluent oil can have an aliphatic sulfur content (aliphatic $sulfur_{DO}$) of less than about 1 wt %, such as less than about 0.6 wt %, such as less than about 0.3 wt %, such as from about 0 wt % to about 0.3 wt %, as measured according to appropriate ASTM or equivalent methods. In at least one embodiment, the aliphatic $sulfur_{DO}$ (in units of wt %) can range from aliphatic $sulfur_{DO}$ t to aliphatic $sulfur_{DO2}$, where each of aliphatic $sulfur_{DO1}$ and aliphatic $sulfur_{DO2}$ is independently about 0, about 0.01, about 0.02, about 0.03, about 0.04, about 0.05, about 0.06, about 0.07, about 0.08, about 0.09, about 0.10, about 0.11, about 0.12, about 0.13, about 0.14, about 0.15, about 0.16, about 0.17, about 0.18, about 0.19, about 0.20, about 0.21, about 0.22, about 0.23, about 0.24, about 0.25, about 0.26, about 0.27, about 0.28, about 0.29, or about 0.30, so long as aliphatic $sulfur_{DO2}>$aliphatic $sulfur_{DO1}$.

In some embodiments, the diluent oil has a total aromatics content (total $aromatics_{DO}$) from about 0 mmol/kg to about 600 mmol/kg as measured according to ASTM D7419. In some embodiments, the total $aromatics_{DO}$ (in units of mmol/kg) can range from total $aromatics_{DO1}$ to total $aromatics_{DO2}$, where each of total $aromatics_{DO1}$ and total $aromatics_{DO2}$ is independently about 0, about 10, about 20, about 30, about 40, about 50, about 60, about 70, about 80, about 90, about 100, about 110, about 120, about 130, about 140, about 150, about 160, about 170, about 180, about 190, about 200, about 210, about 220, about 230, about 240, about 250, about 260, about 270, about 280, about 290, about 300, about 310, about 320, about 330, about 340, about 350, about 360, about 370, about 380, about 390, about 400, about 410, about 420, about 430, about 440, about 450, about 460, about 470, about 480, about 490, about 500, about 510, about 520, about 530, about 540, about 550, about 560, about 570, about 580, about 590, or about 600, so long as total $aromatics_{DO2}>$total $aromatics_{DO1}$.

In at least one embodiment, the diluent oil can have a viscosity index ($VI_{DO}$) of about 85 or more and/or about 120 or less, as measured according to D2270. In some embodiments, the viscosity index of the diluent oil can range from $VI_{DO1}$ to $VI_{DO2}$, where each of $VI_{DO1}$ and $VI_{DO2}$ is independently about 85, about 86, about 87, about 88, about 89, about 90, about 91, about 92, about 93, about 94, about 95, about 96, about 97, about 98, about 99, about 100, about 101, about 102, about 103, about 104, about 105, about 106, about 107, about 108, about 109, about 110, about 111, about 112, about 113, about 114, about 115, about 116, about 117, about 118, about 119, or about 120, so long as $VI_{DO2}>VI_{DO1}$.

In some embodiments, the viscosity modifier concentrate includes an amount of viscosity modifier(s) that can be about 20 wt % or less and/or about 0.1 wt % or more, based on the total weight of the viscosity modifier concentrate. In at least one embodiment, the amount of viscosity modifier(s) in the viscosity modifier concentrate can range from wt $\%_1$ to wt $\%_2$, where each of wt $\%_1$ and wt $\%_2$ (in units of weight percent) is independently about 0.1, about 0.2, about 0.3, about 0.4, about 0.5, about 0.6, about 0.7, about 0.8, about 0.9, about 1.0, about 1.1, about 1.2, about 1.3, about 1.4, about 1.5, about 1.6, about 1.7, about 1.8, about 1.9, about 2.0, about 2.1, about 2.2, about 2.3, about 2.4, about 2.5, about 2.6, about 2.7, about 2.8, about 2.9, about 3.0, about 3.1, about 3.2, about 3.3, about 3.4, about 3.5, about 3.6, about 3.7, about 3.8, about 3.9, about 4.0, about 4.1, about 4.2, about 4.3, about 4.4, about 4.5, about 4.6, about 4.7, about 4.8, about 4.9, about 5.0, about 5.1, about 5.2, about 5.3, about 5.4, about 5.5, about 5.6, about 5.7, about 5.8, about 5.9, about 6.0, about 6.1, about 6.2, about 6.3, about 6.4, about 6.5, about 6.6, about 6.7, about 6.8, about 6.9, about 7.0, about 7.1, about 7.2, about 7.3, about 7.4, about 7.5, about 7.6, about 7.7, about 7.8, about 7.9, about 8.0, about 8.1, about 8.2, about 8.3, about 8.4, about 8.5, about 8.6, about 8.7, about 8.8, about 8.9, about 9.0, about 9.1, about 9.2, about 9.3, about 9.4, about 9.5, about 9.6, about 9.7, about 9.8, about 9.9, about 10.0, about 10.1, about 10.2, about 10.3, about 10.4, about 10.5, about 10.6, about 10.7, about 10.8, about 10.9, about 11.0, about 11.1, about 11.2, about 11.3, about 11.4, about 11.5, about 11.6, about 11.7, about 11.8, about 11.9, about 12.0, about 12.1, about 12.2, about 12.3, about 12.4, about 12.5, about 12.6, about 12.7, about 12.8, about 12.9, about 13.0, about 13.1, about 13.2, about 13.3, about 13.4, about 13.5, about 13.6, about 13.7, about 13.8, about 13.9, about 14.0, about 14.1, about 14.2, about 14.3, about 14.4, about 14.5, about 14.6, about 14.7, about 14.8, about 14.9, about 15.0, about 15.1, about 15.2, about 15.3, about 15.4, about 15.5, about 15.6, about 15.7, about 15.8, about 15.9, about 16.0, about 16.1, about 16.2, about 16.3, about 16.4, about 16.5, about 16.6, about 16.7, about 16.8, about 16.9, about 17.0, about 17.1, about 17.2, about 17.3, about 17.4, about 17.5, about 17.6, about 17.7, about 17.8, about 17.9, about 18.0, about 18.1, about 18.2, about 18.3, about 18.4, about 18.5, about 18.6, about 18.7, about 18.8, about 18.9, about 19.0, about 19.1, about 19.2, about 19.3, about 19.4, about 19.5, about 19.6, about 19.7, about 19.8, about 19.9, or about 20, so long as wt $\%_2$>wt $\%_1$.

In some embodiments, the viscosity modifier concentrate includes an amount of diluent oil(s) that can be about 80 wt % or more and/or about 99.9 wt % or less, based on the total weight of the viscosity modifier concentrate. In at least one embodiment, the amount of diluent oil(s) in the viscosity modifier concentrate can range from wt $\%_3$ to wt $\%_4$, where each of wt $\%_3$ and wt $\%_4$ (in units of weight percent) is independently about 80.0 wt %, about 80.1, about 80.2, about 80.3, about 80.4, about 80.5, about 80.6, about 80.7, about 80.8, about 80.9, about 81.0, about 81.1, about 81.2, about 81.3, about 81.4, about 81.5, about 81.6, about 81.7, about 81.8, about 81.9, about 82.0, about 82.1, about 82.2, about 82.3, about 82.4, about 82.5, about 82.6, about 82.7, about 82.8, about 82.9, about 83.0, about 83.1, about 83.2, about 83.3, about 83.4, about 83.5, about 83.6, about 83.7, about 83.8, about 83.9, about 84.0, about 84.1, about 84.2, about 84.3, about 84.4, about 84.5, about 84.6, about 84.7, about 84.8, about 84.9, about 85.0, about 85.1, about 85.2, about 85.3, about 85.4, about 85.5, about 85.6, about 85.7, about 85.8, about 85.9, about 86.0, about 86.1, about 86.2, about 86.3, about 86.4, about 86.5, about 86.6, about 86.7, about 86.8, about 86.9, about 87.0, about 87.1, about 87.2, about 87.3, about 87.4, about 87.5, about 87.6, about 87.7, about 87.8, about 87.9, about 88.0, about 88.1, about 88.2, about 88.3, about 88.4, about 88.5, about 88.6, about 88.7, about 88.8, about 88.9, about 89.0, about 89.1, about 89.2, about 89.3, about 89.4, about 89.5, about 89.6, about 89.7, about 89.8, about 89.9, about 90.0, about 90.1, about 90.2, about 90.3, about 90.4, about 90.5, about 90.6, about 90.7, about 90.8, about 90.9, about 91.0, about 91.1, about 91.2, about 91.3, about 91.4, about 91.5, about 91.6, about 91.7, about 91.8, about 91.9, about 92.0, about 92.1, about 92.2, about 92.3, about 92.4, about 92.5, about 92.6, about 92.7, about 92.8, about 92.9, about 93.0, about 93.1, about 93.2, about 93.3, about 93.4, about 93.5, about 93.6, about 93.7, about 93.8, about 93.9, about 94.0, about 94.1, about 94.2, about 94.3, about 94.4, about 94.5, about 94.6, about 94.7, about 94.8, about 94.9, about 95.0, about 95.1, about 95.2, about 95.3, about 95.4, about 95.5, about 95.6, about 95.7, about 95.8, about 95.9, about 96.0, about 96.1, about 96.2, about 96.3, about 96.4, about 96.5, about 96.6, about 96.7, about 96.8, about 96.9, about 97.0, about 97.1, about 97.2, about 97.3, about 97.4, about 97.5, about 97.6, about 97.7, about 97.8, about 97.9, about 98.0, about 98.1, about 98.2, about 98.3, about 98.4, about 98.5, about 98.6, about 98.7, about 98.8, about 98.9, about 99.0, about 99.1, about 99.2, about 99.3, about 99.4, about 99.5, about 99.6, about 99.7, about 99.8, or about 99.9, so long as wt $\%_4$>wt $\%_3$.

In some embodiments, the diluent oil used for the viscosity modifier concentrate can include a Group I base oil, Group II base oil, Group III base oil, or a combination thereof, such as a Group I base oil, Group II base oil, or a combination thereof.

The viscosity modifier concentrates of the present disclosure can be prepared by dissolving the viscosity modifier polymer(s) in the diluent oil using well-known techniques. When dissolving a solid viscosity modifier polymer to form a concentrate, the high viscosity of the polymer can cause poor diffusivity in the diluent oil. To facilitate dissolution, it can be common to increase the surface area of the polymer by, e.g., pelletizing, chopping, grinding or pulverizing the polymer. The temperature of the diluent oil can also be increased by heating using, e.g., steam or hot oil. When the diluent temperature is greatly increased (such as to a temperature above about 100° C.), heating can be conducted under a blanket of a non-reactive gas (e.g., $N_2$). The temperature of the polymer can also be raised using, e.g., mechanical energy imparted to the polymer in an extruder or masticator. The polymer temperature can be raised to above about 150° C.; the polymer temperature can be raised under a blanket of non-reactive gas, e.g., $N_2$. Dissolution of the polymer can also be aided by agitating the concentrate, such as by stirring or agitating (in, e.g., a reactor or a tank), or by using a recirculation pump. Any two or more of the foregoing techniques can also be used in combination. Concentrates can also be formed by exchanging the polymerization solvent (which can be a volatile hydrocarbon such as, for example, propane, hexane or cyclohexane) with oil. This exchange can be accomplished by, e.g., using a distillation column to ensure that substantially none of the polymerization solvent remains.

The present disclosure also generally relates to finished lubricant formulations (or a "lubricating oil composition") that includes a viscosity modifier concentrate according to the present disclosure. In some embodiments, the finished lubricant formulations can also include an additive (apart from the viscosity modifier of the viscosity modifier concentrate) and/or a base oil (e.g., a Group I, Group II, Group III, Group IV, Group V base oil, or a combination thereof). Such additives can include, but are not limited to, extreme pressure additives, antioxidants, solubility additives, friction modifiers, antifoam agent, dispersants, detergents, corrosion inhibitors, rust inhibitors, metal deactivators, anti-wear agents, anti-seizure agents, wax modifiers, viscosity index improvers, viscosity modifiers, fluid-loss additives, seal compatibility agents, lubricity agents, anti-staining agents, chromophoric agents, demulsifiers, emulsifiers, densifiers, wetting agents, gelling agents, tackiness agents, colorants, and others, and a combination thereof. For a review of many commonly used additives, see Klamann in Lubricants and Related Products, Verlag Chemie, Deerfield Beach, Fla.; ISBN 0-89573-177-0. Reference is also made to "Lubricant Additives Chemistry and Applications" edited by Leslie R. Rudnick, Marcel Dekker, Inc. New York, 2003 ISBN: 0-8247-0857-1. Non-limiting examples of additives that can be used to form the lubricating oil composition are provided below.

In at least one embodiment, a method of forming a lubricating oil composition can include introducing a base oil (e.g., a Group I, Group II, Group III, Group IV, Group V base oil, or a combination thereof) to a viscosity modifier concentrate of the present disclosure to form a lubricating oil composition. The base oil of the lubricating oil composition can be the same or different as the materials used to make the diluent oil used in the viscosity modifier concentrate. In some embodiments, the method of forming a lubricating oil composition can further include introducing one or more additives to the lubricating oil composition.

The lubricating oil composition of the present disclosure can be prepared by blending the viscosity modifier concentrates in a base oil using well-known techniques.

In some embodiments, the lubricating oil composition can include an amount of an additive (apart from the viscosity modifier of the viscosity modifier concentrate) that is about 20 wt % or less, or about 0.1 wt % or more, based on the total weight of the lubricating oil composition. In at least one embodiment, the amount of such additive(s) in the lubricating oil composition can range from wt % s to wt/6, where each of wt % s and wt %6 (in units of weight percent) is independently about 0.1, about 0.2, about 0.3, about 0.4, about 0.5, about 0.6, about 0.7, about 0.8, about 0.9, about 1.0, about 1.1, about 1.2, about 1.3, about 1.4, about 1.5, about 1.6, about 1.7, about 1.8, about 1.9, about 2.0, about 2.1, about 2.2, about 2.3, about 2.4, about 2.5, about 2.6, about 2.7, about 2.8, about 2.9, about 3.0, about 3.1, about 3.2, about 3.3, about 3.4, about 3.5, about 3.6, about 3.7, about 3.8, about 3.9, about 4.0, about 4.1, about 4.2, about 4.3, about 4.4, about 4.5, about 4.6, about 4.7, about 4.8, about 4.9, about 5.0, about 5.1, about 5.2, about 5.3, about 5.4, about 5.5, about 5.6, about 5.7, about 5.8, about 5.9, about 6.0, about 6.1, about 6.2, about 6.3, about 6.4, about 6.5, about 6.6, about 6.7, about 6.8, about 6.9, about 7.0, about 7.1, about 7.2, about 7.3, about 7.4, about 7.5, about 7.6, about 7.7, about 7.8, about 7.9, about 8.0, about 8.1, about 8.2, about 8.3, about 8.4, about 8.5, about 8.6, about 8.7, about 8.8, about 8.9, about 9.0, about 9.1, about 9.2, about 9.3, about 9.4, about 9.5, about 9.6, about 9.7, about 9.8, about 9.9, about 10.0, about 10.1, about 10.2, about 10.3, about 10.4, about 10.5, about 10.6, about 10.7, about 10.8, about 10.9, about 11.0, about 11.1, about 11.2, about 11.3, about 11.4, about 11.5, about 11.6, about 11.7, about 11.8, about 11.9, about 12.0, about 12.1, about 12.2, about 12.3, about 12.4, about 12.5, about 12.6, about 12.7, about 12.8, about 12.9, about 13.0, about 13.1, about 13.2, about 13.3, about 13.4, about 13.5, about 13.6, about 13.7, about 13.8, about 13.9, about 14.0, about 14.1, about 14.2, about 14.3, about 14.4, about 14.5, about 14.6, about 14.7, about 14.8, about 14.9, about 15.0, about 15.1, about 15.2, about 15.3, about 15.4, about 15.5, about 15.6, about 15.7, about 15.8, about 15.9, about 16.0, about 16.1, about 16.2, about 16.3, about 16.4, about 16.5, about 16.6, about 16.7, about 16.8, about 16.9, about 17.0, about 17.1, about 17.2, about 17.3, about 17.4, about 17.5, about 17.6, about 17.7, about 17.8, about 17.9, about 18.0, about 18.1, about 18.2, about 18.3, about 18.4, about 18.5, about 18.6, about 18.7, about 18.8, about 18.9, about 19.0, about 19.1, about 19.2, about 19.3, about 19.4, about 19.5, about 19.6, about 19.7, about 19.8, about 19.9, or about 20, so long as wt $\%_6$>wt $\%_5$.

In some embodiments, the lubricating oil composition includes an amount of a base oil, such as a Group III base oil (apart from the Group III oil, if any, in the viscosity modifier concentrate). In at least one embodiment, the lubricating oil composition can have one or more of the following properties:

(1) A KV100 that can be at least 1, or 3.5 to 38, or 4 to 32 or 4 to 28, or 4 to 12 or 4 to 6 or 5 to 10, as measured according to ASTM D445;

(2) A HTHS viscosity (at 150° C.) that can be from about 1 millipascal-seconds (mPa·s) to about 4 mPa·s, such as from about 1.25 mPa·s to about 3.75 mPa·s, such as from about 1.5 mPa s to about 3.5 mPa·s, such as from about 1.75 mPa·s to about 3.25 mPa·s, such as from about 2 mPa·s to about 3 mPa·s, such as from about 2.25 mPa·s to about 2.75 mPa·s, as measured according to ASTM D4683.

(3) A cold cranking simulator viscosity (at −30° C.) that can be from about 4,000 mPa·s to about 7,000 mPa·s, such as from about 4,250 to about 6,750, such as from about 4,500 to about 6,500, such as from about 4,750 to about 6,250, such as from about 5,000 to about 6,000, such as from about 5,250 to about 5,750, as measured according to ASTM D5293; or (4) A mini-rotary viscometer (MRV) viscosity that can be from about 10,000 mPa·s to about 60,000 mPa s, such as from about 20,000 mPa·s to about 50,000 mPa s, such as from about 30,000 mPa·s to about 40,000, mPa·s as measured according to ASTM D4684.

Viscosity Modifiers

Viscosity modifiers (also known as viscosity index improvers (VI improvers)), and viscosity improvers) can be included in the lubricant compositions of this disclosure. Viscosity index improvers can provide lubricants with high and low temperature operability. These additives can impart shear stability at elevated temperatures and acceptable viscosity at low temperatures.

Suitable viscosity index improvers can include high molecular weight hydrocarbons, polyesters, and viscosity index improver dispersants that function as both a viscosity index improver and a dispersant.

Examples of viscosity index improvers can include linear polymers, star-shaped polymers, and copolymers of methacrylate, butadiene, olefins, or alkylated styrenes. Polyisobutylene can also be used. Another example VI improver can be polymethacrylate (copolymers of various chain length alkyl methacrylates, for example), copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

In at least one embodiment, the VI improver can include ethylene-α-olefin copolymers (OCP) synthesized from ethylene monomer and at least one other α-olefin comonomer. The average ethylene content of OCP useful in the present disclosure can be as low as about 20% on a mass basis, such as about 25%, such as about 30%. The maximum ethylene content can be about 90% on a mass basis, such as about 85%, such as about 80%. OCP intended for use as viscosity modifiers typically comprise from about 35 wt % to 75 wt % ethylene, but can be "amorphous" or substantially amorphous copolymers comprising less than about 60 mass %, (e.g., about 40 mass % to about 56 mass %) ethylene. Crystalline ethylene-α-olefin copolymers are defined as those comprising greater than about 60 mass ethylene (e.g. from about 60 to about 90 mass % ethylene). Conversely, amorphous or substantially amorphous ethylene-α-olefin copolymers used as VI improvers typically comprise from about 25 mass % to about 60 mass % ethylene, such as from about 30 mass % to about 60 mass % ethylene, such as from about 35 mass % to about 60 mass % ethylene. Ethylene content can be measured by ASTM-D3900 for ethylene-propylene copolymers containing from about 35 mass % to about 85 mass % ethylene. Above about 85 mass %, ASTM-D2238 can be used to obtain methyl group concentration, which is related to percent ethylene in an unambiguous manner for ethylene-propylene copolymers. When comonomers other than propylene are employed, proton and carbon-i3 nuclear magnetic resonance spectroscopy can be employed to determine the composition of such polymers. These are absolute techniques requiring no calibration when operated such that all nuclei of a given element contribute equally to the spectra. For ethylene content ranges not covered by ASTM tests for ethylene-propylene copolymers, as well as for any ethylene-propylene copolymers, the aforementioned nuclear magnetic resonance methods can also be used.

As noted, the ethylene-α-olefin copolymers are comprised of ethylene and at least one other α-olefin. The other α-olefin can include those containing 3 to 18 carbon atoms, such as 3 to 6 carbon atoms, e.g., propylene, butene-1, pentene-1), for example ethylene and propylene. Copolymers of ethylene and higher alpha-olefins such as propylene can optionally include other polymerizable monomers. These other monomers can include non-conjugated dienes such as the following non-limiting examples: (a) straight chain acyclic dienes such as 1,4-hexadiene and 1,6-octadiene; (b) branched chain acyclic dienes such as 5-methyl-1,4-hexadiene, 3,7-dimethyl-1,6-octadiene, 3,7-dimethyl-1,7-octadiene, and the mixed isomers of dihydro-mycene and dihydroocinene; (c) single ring alicyclic dienes such as 1,4-cyclohexadiene, 1,5-cyclooctadiene, and 1,5-cyclododecadiene; and (d) multi-ring alicyclic fused and bridged ring dienes such as tetrahydroindene, methyltetrahydroindene, dicyclopentadiene, bicyclo-(2,2,1)-hepta-2,5-diene, alkenyl, alkylidene, cycloalkenyl and cycloalkylidene norbornenes such as 5-methylene-2-norbornene (MNB), 5-ethylidene-2-norbornene (ENB), 5-propylene-2-norbornene, 5isopropylidene-2-norbornene, 5-(4-cyclopentenyl)-2-norbornene; and 5-cyclohexylidene-2-norbornene. In at least one embodiment, dienes containing dienes containing at least one of the double bonds in a strained ring can be used to prepare these copolymers, such as 5-ethylidene-2-norbornene (ENB).

In at least one embodiment, and when present, the amount of diene (on a weight basis) in the copolymer can be from greater than about 0 wt % to about 20 wt %, such as from greater than about 0 wt % to about 15 wt %, such as greater than about 0 wt % to about 10 wt %.

In some embodiments, the molecular weight of OCP useful in accordance with the present disclosure can vary over a wide range since ethylene copolymers having a number-average molecular weight ($M_n$) as low as about 2,000 g/mol can affect the viscosity properties of an oleaginous composition. In some embodiments, the $M_n$ of the OCP can be about 10,000 g/mol or more, such as from about 10,000 g/mol to about 12,000,000 g/mol, such as from about 20,000 g/mol to about 10,000,000 g/mol, such as from about 50,000 g/mol to about 5,000,000 g/mol, such as from about 100,000 g/mol to about 5,000,000, such as from about 200,000 g/mol to about 750,000 g/mol. In at least one embodiment the $M_n$ for OCP useful in the present disclosure can be from about 10,000 g/mol to about 1,500,000 g/mol, such as from about 20,000 g/mol to about 1,200,000 g/mol, such as from about 50,000 g/mol to about 1,000,000 g/mol, such as from about 75,000 g/mol to about 500,000 g/mol, such as from about 100,000 g/mol to about 400,000 g/mol, such as from about 150,000 g/mol to about 250,000 g/mol. The term "number average molecular weight", as used herein, refers to the number average weight as measured by Gel Permeation Chromatography ("GPC") with a polystyrene standard.

Other VI improvers useful in the practice of the disclosure can include homopolymers and copolymers of diolefins, such as those diolefins containing from about 4 to about 12 carbon atoms or from about 8 to about 16 carbon atoms, such as 1,3-butadiene, isoprene, piperylene, methylpentadiene, phenylbutadiene, 3,4-dimethyl-1,3-hexadiene, 4,5-diethyl-1,3-octadiene, and copolymers of one or more conjugated diolefins and one or more monoalkenyl aromatic hydrocarbons containing from about 8 to about 16 carbon atoms such as aryl-substituted styrenes, alkoxy-substituted styrenes, vinyl naphthalene, alkyl-substituted vinyl naphthalenes, and the like. Such polymers and copolymers can include random polymers, tapered polymers, and block copolymers and may be of a star or linear structure.

In at least one embodiment, linear block copolymers useful in accordance with the present disclosure may be represented by the following general formula:

$$A_z\text{-}(B\text{-}A)_y\text{-}B_x$$

wherein: A is a polymeric block comprising predominantly monoalkenyl aromatic hydrocarbon monomer units; B is a polymeric block comprising predominantly conjugated diolefin monomer units; x and z are, independently, a number equal to 0 or 1; and y is a whole number ranging from 1 to about 15.

In at least one embodiment, tapered linear block copolymers useful in accordance with the present disclosure may be represented by the following general formula:

$$A\text{-}A/B\text{-}B$$

wherein: A is a polymeric block comprising predominantly monoalkenyl aromatic hydrocarbon monomer units; B is a polymeric block comprising predominantly conjugated diolefin monomer units; and A/B is a tapered segment containing both monoalkenyl aromatic hydrocarbon and conjugated diolefin units.

In at least one embodiment, radial or star polymers useful in accordance with the present disclosure may be represented, generally, by the following general formula:

$$(B_x\text{-}(A\text{-}B)_y\text{-}A_z)_n\text{-}C; \text{ and}$$

$$(B'_x\text{-}(A\text{-}B)_y\text{-}A_y)_{n'}\text{-}(B'')_{n''}$$

wherein: A, B, x, y and z are as previously defined; n is a number from 3 to 30; C is the core of the radial polymer formed with a polyfunctional coupling agent; B' is a polymeric block comprising predominantly conjugated diolefin units, which B' may be the same or different from B; and n' and n" are integers representing the number of each type of arm and the sum of n' and n" will be a number from 3 to 30.

As used herein in connection with polymer block composition, predominantly means that the specified monomer or monomer type which is the principle component in that polymer block is present in an amount of at least 85% by weight of the block.

Polymers prepared with diolefins can contain ethylenic unsaturation, and such polymers can be hydrogenated. When the polymer is hydrogenated, the hydrogenation may be accomplished using any suitable technique known in the art. For example, the hydrogenation can be accomplished such that both ethylenic and aromatic unsaturation is converted (saturated) using methods such as those, for example, in U.S. Pat. Nos. 3,113,986 and 3,700,633, or the hydrogenation may be accomplished selectively such that a significant portion of the ethylenic unsaturation is converted while little or no aromatic unsaturation is converted using methods such as those, for example, in U.S. Pat. Nos. 3,634,595, 3,670,054, and 3,700,633. Any of these methods can also be used to hydrogenate polymers containing only ethylenic unsaturation and which are free of aromatic unsaturation.

In at least one embodiment, polymeric VI improvers may include mixtures of linear polymers as disclosed above, but having different molecular weights and/or different alkenyl aromatic contents as well as mixtures of star polymers having different molecular weights and/or different alkenyl aromatic contents. Alternatively, and in at least one embodiment, mixtures of star polymers and linear polymers having different molecular weights and/or different alkenyl aromatic contents may be used. The use of two or more different polymers may be used depending on the rheological properties the product is intended to impart when used to produce viscosity modifier concentrates and/or lubricating oil compositions. In at least one embodiment, mixtures of, for example, OCP and star polymers can be used.

In at least one embodiment, the number average molecular weight can be from about 200,000 g/mol to about 1,500,000 g/mol, such as from about 350,000 g/mol to about 900,000 g/mol, such as from about 400,000 g/mol to about 800,000 g/mol, such as from about 500,000 g/mol to about 700,000 g/mol, such as from about 600,000 g/mol to about 650,000 g/mol for the base polymer when the base polymer is a star-configuration hydrogenated polymer of one or more conjugated olefins or a star configuration polymer of one or more alpha olefins. In at least one embodiment, when the base polymer is a star configuration copolymer containing about 3% by weight or more of monoalkenyl arenes, the number average molecular weight can be from about 200,000 g/mol to about 1,500,000 g/mol, such as from about 350,000 g/mol to about 900,000 g/mol, such as from about 400,000 g/mol to about 800,000 g/mol, such as from about 500,000 g/mol to about 700,000 g/mol, such as from about 600,000 g/mol to about 650,000 g/mol.

In at least one embodiment, when the base polymer is a copolymer of monoalkenyl arene and polymerized alpha olefins, hydrogenated polymerized diolefins or combinations thereof, the amount of monoalkenyl arene in the base polymer can be from about 5% by weight to about 40% by weight of the base polymer. For such polymers, number average molecular weight can be from about 85,000 to about 300,000 are acceptable.

Useful copolymers of this type include those prepared in bulk, suspension, solution or emulsion. Polymerization of monomers to produce hydrocarbon polymers may be accomplished using free-radical, cationic and anionic initiators or polymerization catalysts, such as transition metal catalysts used for Ziegler-Natta and metallocene type catalysts.

Example olefin copolymers, are commercially available from Chevron Oronite Company LLC under the trade designation PARATONE™ (such as PARATONE™ 8921 and PARATONE 8941); from Afton Chemical Corporation under the trade designation HiTEC™ (such as HiTEC™ 5850B); and from The Lubrizol Corporation under the trade designation Lubrizol™ 7067C. Polyisoprene polymers are commercially available from Infineum International Limited, e.g. under the trade designation SV200; diene-styrene copolymers are commercially available from Infineum International Limited, e.g. under the trade designation SV 260.

In some embodiments, the VI improver can include nitrogen-containing functional groups that impart dispersant capabilities to the VI improver. Such "multifunctional" VI improvers in lubricants can be used to replace some or all of the dispersant. Nitrogen-containing functional groups can be added to a polymeric VI improver by grafting a nitrogen- or hydroxyl-containing moiety, preferably a nitrogen-containing moiety, onto the polymeric backbone of the VI improver (functionalizing). Processes for the grafting of a nitrogen-containing moiety onto a polymer can include, for example, contacting the polymer and nitrogen-containing moiety in the presence of a free radical initiator, either neat, or in the presence of a solvent. The free radical initiator may be generated by shearing (as in an extruder) or heating a free radical initiator precursor, such as hydrogen peroxide.

The amount of nitrogen-containing grafting monomer can depend on the nature of the substrate polymer and the level of dispersancy required of the grafted polymer. To impart dispersancy characteristics to both star and linear copolymers, the amount of grafted nitrogen-containing monomer can be from about 0.4 wt % to about 2.2 wt %, such as from about 0.5 wt % to about 1.8 wt %, such as from about 0.6 wt % to about 1.2 wt %, based on a total weight of grafted polymer.

Example methods for grafting nitrogen-containing monomer onto polymer backbones, and suitable nitrogen-containing grafting monomers include those described, for example, in U.S. Pat. No. 5,141,996, WO 98/13443, WO 99/21902, U.S. Pat. Nos. 4,146,489, 4,292,414, and 4,506,056. (See also *J Polymer Science*, Part A: Polymer Chemistry, Vol. 26, 1189-1198 (1988); *J. Polymer Science*, Polymer Letters, Vol. 20, 481-486 (1982) and *J. Polymer Science*, Polymer Letters, Vol. 21, 23-30 (1983), all to Gaylord and Mehta and *Degradation and Cross-linking of Ethylene-Propylene Copolymer Rubber on Reaction with Maleic Anhydride and/or Peroxides; J. Applied Polymer Science*, Vol. 33, 2549-2558 (1987) to Gaylord, Mehta and Mehta.

II. Additive Package Concentrates and Lubricating Oil Compositions Comprising Such The present disclosure also generally relates to additive package concentrates, to methods of making additive package concentrates, to lubricating oil compositions comprising additive package concentrates, and to methods of making lubricating oil compositions. Typical diluent oils for additive packages include Group I and Group II base oils. Group I base oils can be preferred due to enhanced solubility, while Group II base oils may not be preferred due to poor solubility. In order to have a diluent oil exhibiting an increase in solubility, the aromatic content of the diluent oil can be increased, however, the oxidation stability of the diluent oil is compromised.

The inventors have found that Group I base oils with high aromatic content are superior in performance for solubility (as measured by aniline point), but directionally weaker in oxidation stability (as measured by turbine oil oxidation stability test, TOST). However, the inventors also found that Group I base oils having higher aromatic content also contain higher amounts of aliphatic sulfur, and their oxidation stability (as measured by TOST) is maintained over Group I higher aromatic content base oils that have low amounts of aliphatic sulfur. In addition, higher amounts of aliphatic sulfur can also improve solubility. This unique combination of properties surprisingly provides a diluent oil with good solvency and oxidation stability. Embodiments of the present disclosure, then, can enable improved performance of diluent oil for additives packages by enhancing solubility through an increase in aliphatic sulfur and aromatic content while keeping the oxidation stability satisfactory through an increase in aliphatic sulfur. In at least one embodiment, when the aromatic content and aliphatic sulfur of the diluent oil are increased, the solubility of the diluent oil will also increase without compromising the oxidation stability of the diluent oil.

In at least one embodiment, the additive package concentrate includes a diluent oil and an additive. The additive concentrate can include more than one additive in any proportion and/or more than one diluent oil in any proportion. Illustrative, non-limiting examples of additives and diluent oils useful for the additive package concentrates are provided below.

The following table summarizes typical kinematic viscosity at 40° C., aniline point, total aromatics content, and aliphatic sulfur content of typical Group I, II, and III base oils. Americas CORE™ 100, 150, and 600 are Group I base oils available from ExxonMobil. EHC™ 45 (ExxonMobil) and Motiva STAR™ 4 (Motiva Enterprises) are Group II base oils. VISOM™ 4 (ExxonMobil) and YUBASE™ 4 (SK Lubricants) are Group III base oils.

| Base Oil | KV 40° C. (cSt) | Aniline Point (° C.) | Total Aromatics (mmol/kg) | Aliphatic Sulfur (wt %) |
|---|---|---|---|---|
| CORE ™ 100 | 20.4 | 99.4 | 369.6 | 0.2 |
| CORE ™ 150 | 30.58 | 100.6 | 566.6 | 0.16 |
| CORE ™ 600 | 112.2 | 115.6 | 411.1 | 0.17 |
| EHC ™ 45 | 23.5 | 113.8 | <1.0 | — |
| Motiva STAR ™ 4 | 19.6 | 107.5 | 90.7 | 0.001 |
| VISOM ™ 4 | 17.0 | 119.4 | 0.1 | — |
| YUBASE ™ 4 | 19.3 | 115.3 | <1.0 | — |

In at least one embodiment, a method of forming an additive package concentrate can include selecting one or more additives for the additive package concentrate; selecting a diluent oil to combine with the one or more additives based on Equation 2 and Equation 3; and introducing the one or more additives to the diluent oil to form the additive package concentrate.

$$\text{aniline point}_{DO}=105.694-(0.01507*\text{total aromatics}_{DO})-(11.21*\text{aliphatic sulfur}_{DO})+(0.15469*\text{KV40}_{DO}) \quad \text{(Eq. 2)}$$

$$\text{TOST}_{DO}=4626-(10202*(2+\text{ring aromatics}_{DO}/\text{total aromatics}_{DO}))+(2065*\text{aliphatic sulfur}_{DO}) \quad \text{(Eq. 3)}$$

In Equations 2 and 3, aniline point$_{DO}$ is the aniline point of the diluent oil in units of ° C., TOST$_{DO}$ is the turbine oil oxidation stability test value of the diluent oil in units of hours, the aliphatic sulfur$_{DO}$ is the amount (wt %) of aliphatic sulfur in the diluent oil as measured by a suitable ASTM or equivalent method, the KV40$_{DO}$ is the kinematic viscosity (cSt) at 40° C. of the diluent oil as measured according to ASTM D445, the total aromatic$_{DO}$ is the amount (mmol/kg) of 1+ring aromatics in the diluent oil as measured according to ASTM D7419, and the 2+ring aromatics$_{DO}$ is the amount (mmol/kg) of 2+ring aromatics in the diluent oil as measured by a suitable ASTM or equivalent method. Equation 2 and Equation 3 illustrate relationships between the various properties of base oils.

In some embodiments, the aniline point$_{DO}$ is from about from 95° C. to 120° C. and the TOST$_{DO}$ is from about 1350 hours to about 3950 hours.

In at least one embodiment, the aniline point$_{DO}$ can be from about 95° C. to about 120° C. (ASTM D611). In some embodiments, the aniline point$_{DO}$ (in units of ° C.) can range from aniline point$_{DO3}$ to aniline point$_{DO4}$, where each of aniline point$_{DO3}$ and aniline point$_{DO4}$ is independently about 95, about 96, about 97, about 98, about 99, about 100, about 101, about 102, about 103, about 104, about 105, about 106, about 107, about 108, about 109, about 110, about 111, about 112, about 113, about 114, about 115, about 116, about 117, about 118, about 119, about 120, about 121, about 122, about 123, about 124, or about 125, so long as aniline point$_{DO4}$>aniline point$_{DO3}$. In at least one embodiment, the aniline point$_{DO}$ can be from about 95° C. to about 116° C.

In at least one embodiment, the TOST$_{DO}$ can be from about 1350 hours (h) to about 3950 h. In some embodiments, the TOST$_{DO}$ (in units of h) can range from TOST$_{DO1}$ to TOST$_{DO2}$, where each of TOST$_{DO1}$ and TOST$_{DO2}$ is independently about 1350, about 1360, about 1370, about 1380, about 1390, about 1400, about 1410, about 1420, about 1430, about 1440, about 1450, about 1460, about 1470, about 1480, about 1490, about 1500, about 1510, about 1520, about 1530, about 1540, about 1550, about 1560, about 1570, about 1580, about 1590, about 1600, about 1610, about 1620, about 1630, about 1640, about 1650, about 1660, about 1670, about 1680, about 1690, about 1700, about 1710, about 1720, about 1730, about 1740, about 1750, about 1760, about 1770, about 1780, about 1790, about 1800, about 1810, about 1820, about 1830, about 1840, about 1850, about 1860, about 1870, about 1880, about 1890, about 1900, about 1910, about 1920, about 1930, about 1940, about 1950, about 1960, about 1970, about 1980, about 1990, about 2000, about 2010, about 2020, about 2030, about 2040, about 2050, about 2060, about 2070, about 2080, about 2090, about 2100, about 2110, about 2120, about 2130, about 2140, about 2150, about 2160, about 2170, about 2180, about 2190, about 2200, about 2210, about 2220, about 2230, about 2240, about 2250, about 2260, about 2270, about 2280, about 2290, about 2300, about 2310, about 2320, about 2330, about 2340, about 2350, about 2360, about 2370, about 2380, about 2390, about 2400, about 2410, about 2420, about 2430, about 2440, about 2450, about 2460, about 2470, about 2480, about 2490, about 2500, about 2510, about 2520, about 2530, about 2540, about 2550, about 2560, about 2570, about 2580, about 2590, about 2600, about 2610, about 2620, about 2630, about 2640, about 2650, about 2660, about 2670, about 2680, about 2690, about 2700, about 2710, about 2720, about 2730, about 2740, about 2750, about 2760, about 2770, about 2780, about 2790, about 2800, about 2810, about 2820, about 2830, about 2840, about 2850, about 2860, about 2870, about 2880, about 2890, about 2900, about 2910, about 2920, about 2930, about 2940, about 2950, about 2960, about 2970, about 2980, about 2990, about 3000, about 3010, about 3020, about 3030, about 3040, about 3050, about 3060, about 3070, about 3080, about 3090, about 3100, about 3110, about 3120, about 3130, about 3140, about 3150, about 3160, about 3170, about 3180, about 3190, about 3200, about 3210, about 3220, about 3230, about 3240, about 3250, about 3260, about 3270, about 3280, about 3290, about 3300, about 3310, about 3320, about 3330, about 3340, about 3350, about 3360, about 3370, about 3380, about 3390, about 3400, about 3410, about 3420, about 3430, about 3440, about 3450, about 3460, about 3470, about 3480, about 3490, about 3500, about 3510, about 3520, about 3530, about 3540, about 3550, about 3560, about 3570, about 3580, about 3590, about 3600, about 3610, about 3620, about 3630, about 3640, about 3650, about 3660, about 3670, about 3680, about 3690, about 3700, about 3710, about 3720, about 3730, about 3740, about 3750, about 3760, about 3770, about 3780, about 3790, about 3800, about 3810, about 3820, about 3830, about 3840, about 3850, about 3860, about 3870, about 3880, about 3890, about 3900, about 3910, about 3920, about 3930, about 3940, or about 3950, so long as TOST$_{DO2}$>TOST$_{DO1}$. In at least one embodiment, the TOST$_{DO}$ can be from about 1560 h to about 3355 h.

In at least one embodiment, the KV40$_{DO}$ (ASTM D445) can be from about 19 cSt to about 115 cSt. In some embodiments, the $KV40_{DO}$ (in units of cSt) can range from $KV40_{DO3}$ to $KV40_{DO4}$, where each of $KV40_{DO3}$ and $KV40_{DO4}$ is independently about 19, about 20, about 21, about 22, about 23, about 24, about 25, about 26, about 27, about 28, about 29, about 30, about 31, about 32, about 33, about 34, about 35, about 36, about 37, about 38, about 39, about 40, about 41, about 42, about 43, about 44, about 45, about 46, about 47, about 48, about 49, about 50, about 51, about 52, about 53, about 54, about 55, about 56, about 57, about 58, about 59, about 60, about 61, about 62, about 63, about 64, about 65, about 66, about 67, about 68, about 69, about 70, about 71, about 72, about 73, about 74, about 75, about 76, about 77, about 78, about 79, about 80, about 81, about 82, about 83, about 84, about 85, about 86, about 87, about 88, about 89, about 90, about 91, about 92, about 93, about 94, about 95, about 96, about 97, about 98, about 99, about 100, about 101, about 102, about 103, about 104, about 105, about 106, about 107, about 108, about 109, about 110, about 111, about 112, about 113, about 114, or about 115 cSt, so long as $KV40_{DO4}>KV40_{DO3}$.

In some embodiments, the aliphatic $sulfur_{DO}$ can be from about 0.05 wt % to about 0.45 wt %. In at least one embodiment the aliphatic $sulfur_{DO}$ (in units of wt %) can range from aliphatic $sulfur_{DO3}$ to aliphatic $sulfur_{DO4}$, where each of aliphatic $sulfur_{DO3}$ and aliphatic $sulfur_{DO4}$ is independently about 0.05, about 0.06, about 0.07, about 0.08, about 0.09, about 0.1, about 0.11, about 0.12, about 0.13, about 0.14, about 0.15, about 0.16, about 0.17, about 0.18, about 0.19, about 0.2, about 0.21, about 0.22, about 0.23, about 0.24, about 0.25, about 0.26, about 0.27, about 0.28, about 0.29, about 0.30, about 0.31, about 0.32, about 0.33, about 0.34, about 0.35, about 0.36, about 0.37, about 0.38, about 0.39, about 0.4, about 0.41, about 0.42, about 0.43, about 0.44, or about 0.45 wt %, so long as aliphatic $sulfur_{DO}$>aliphatic $sulfur_{DO3}$.

In at least one embodiment, the total $aromatics_{DO}$ (ASTM D7419) can be from about 340 mmol/kg to about 810 mmol/kg. In some embodiments, the total $aromatics_{DO}$ (in units of mmol/kg) can range from total $aromatics_{DO3}$ to total $aromatics_{DO4}$, where each of total $aromatics_{DO3}$ and total $aromatics_{DO4}$ is independently about 340, about 350, about 360, about 370, about 380, about 390, about 400, about 410, about 420, about 430, about 440, about 450, about 460, about 470, about 480, about 490, about 500, about 510, about 520, about 530, about 540, about 550, about 560, about 570, about 580, about 590, about 600, about 610, about 620, about 630, about 640, about 650, about 660, about 670, about 680, about 690, about 700, about 710, about 720, about 730, about 740, about 750, about 760, about 770, about 780, about 790, about 800, or about 810, so long as total $aromatics_{DO4}$>total $aromatics_{DO3}$.

In some embodiments, the 2+ring $aromatics_{DO}$ can be from about 45 mmol/kg to about 255 mmol/kg. In at least one embodiment, the 2+ring $aromatics_{DO}$ (in units of mmol/kg) can range from 2+ring $aromatics_{DO1}$ to 2+ring $aromatics_{DO2}$, where each of 2+ring $aromatics_{DO1}$ and 2+ring $aromatics_{DO2}$ is independently about 45, about 50, about 55, about 60, about 65, about 70, about 75, about 80, about 85, about 90, about 95, about 100, about 105, about 110, about 115, about 120, about 125, about 130, about 135, about 140, about 145, about 150, about 155, about 160, about 165, about 170, about 175, about 180, about 185, about 190, about 195, about 200, about 205, about 210, about 215, about 220, about 225, about 230, about 235, about 240, about 245, about 250, or about 255, so long as 2+ring $aromatics_{DO2}$>2+ring $aromatics_{DO1}$.

In at least one embodiment, the 2-ring aromatics content of the diluent oil can be from about 45 mmol/kg to about 180 mmol/kg. In some embodiments, the 2-ring aromatics content of the diluent oil (in units of mmol/kg) can range from 2-ring $aromatics_{DO1}$ to 2-ring $aromatics_{DO2}$, where each of 2-ring $aromatics_{DO1}$ and 2-ring $aromatics_{DO2}$ is independently about 45, about 46, about 47, about 48, about 49, about 50, about 51, about 52, about 53, about 54, about 55, about 56, about 57, about 58, about 59, about 60, about 61, about 62, about 63, about 64, about 65, about 66, about 67, about 68, about 69, about 70, about 71, about 72, about 73, about 74, about 75, about 76, about 77, about 78, about 79, about 80, about 81, about 82, about 83, about 84, about 85, about 86, about 87, about 88, about 89, about 90, about 91, about 92, about 93, about 94, about 95, about 96, about 97, about 98, about 99, about 100, about 101, about 102, about 103, about 104, about 105, about 106, about 107, about 108, about 109, about 110, about 111, about 112, about 113, about 114, about 115, about 116, about 117, about 118, about 119, about 120, about 121, about 122, about 123, about 124, about 125, about 126, about 127, about 128, about 129, about 130, about 131, about 132, about 133, about 134, about 135, about 136, about 137, about 138, about 139, about 140, about 141, about 142, about 143, about 144, about 145, about 146, about 147, about 148, about 149, about 150, about 151, about 152, about 153, about 154, about 155, about 156, about 157, about 158, about 159, about 160, about 161, about 162, about 163, about 164, about 165, about 166, about 167, about 168, about 169, about 170, about 171, about 172, about 173, about 174, about 175, about 176, about 177, about 178, about 179, or about 180, so long as 2-ring $aromatics_{DO2}$>2-ring $aromatics_{DO1}$.

In some embodiments, a ratio of 2+ring $aromatics_{DO}$ to total $aromatics_{DO}$ ($2+ring_{DO}/TA_{DO}$) can be from about 0.14 to about 0.36. In at least one embodiment, the $2+ring_{DO}/TA_{DO}$ can range from $(2+ring_{DO}/TA_{DO})_1$ to $(2+ring_{DO}/TA_{DO})_2$, where each of $(2+ring_{DO}/TA_{DO})_1$ and $(2+ring_{DO}/TA_{DO})_2$ is independently about 0.14, about 0.15, about 0.16, about 0.17, about 0.18, about 0.19, about 0.20, about 0.21, about 0.22, about 0.23, about 0.24, about 0.25, about 0.26, about 0.27, about 0.28, about 0.29, about 0.30, about 0.31, about 0.32, about 0.33, about 0.34, about 0.35, or about 0.36, so long as $(2+ring_{DO}/TA_{DO})_2>(2+ring_{DO}/TA_{DO})_1$.

In some embodiments, a ratio of 2-ring $aromatics_{DO}$ to total $aromatics_{DO}$ ($2-ring_{DO}/TA_{DO}$) can be from about 0.14 to about 0.23. In at least one embodiment, the $2-ring_{DO}/TA_{DO}$ can range from $(2-ring_{DO}/TA_{DO})_1$ to $(2-ring_{DO}/TA_{DO})_2$, where each of $(2-ring_{DO}/TA_{DO})_1$ and $(2-ring_{DO}/TA_{DO})_2$ is independently about 0.14, about 0.15, about 0.16, about 0.17, about 0.18, about 0.19, about 0.20, about 0.21, about 0.22, or about 0.23, so long as $(2-ring_{DO}/TA_{DO})_2>(2-ring_{DO}/TA_{DO})_1$.

In at least one embodiment, the $KV100_{DO}$ (ASTM D445) can be from about 3.9 cSt to about 12.5 cSt. In some embodiments, the $KV100_{DO}$ (in units of cSt) can range from $KV100_{DO3}$ to $KV100_{DO4}$, where each of $KV100_{DO3}$ and $KV100_{DO4}$ is independently about 3.9, about 4.0, about 4.1, about 4.2, about 4.3, about 4.4, about 4.5, about 4.6, about 4.7, about 4.8, about 4.9, about 5.0, about 5.1, about 5.2, about 5.3, about 5.4, about 5.5, about 5.6, about 5.7, about 5.8, about 5.9, about 6.0, about 6.1, about 6.2, about 6.3, about 6.4, about 6.5, about 6.6, about 6.7, about 6.8, about 6.9, about 7.0, about 7.1, about 7.2, about 7.3, about 7.4, about 7.5, about 7.6, about 7.7, about 7.8, about 7.9, about 8.0, about 8.1, about 8.2, about 8.3, about 8.4, about 8.5, about 8.6, about 8.7, about 8.8, about 8.9, about 9.0, about 9.1, about 9.2, about 9.3, about 9.4, about 9.5, about 9.6, about 9.7, about 9.8, about 9.9, about 10.0, about 10.1, about 10.2, about 10.3, about 10.4, about 10.5, about 10.6, about 10.7, about 10.8, about 10.9, about 11.0, about 11.1, about 11.2, about 11.3, about 11.4, about 11.5, about 11.6, about 11.7, about 11.8, about 11.9, about 12.0, about 12.1, about 12.2, about 12.3, about 12.4, or about 12.5, so long as $KV100_{DO4}>KV100_{DO3}$.

In some embodiments, the diluent oil useful for additive packages can have the characteristics shown in the following table.

| Property | Units | min | max |
|---|---|---|---|
| Calculated Aniline Point | ° C. | 95.2 | 115.87 |
| Calculated TOST | hours | 1569 | 3352 |
| $KV40_{DO}$ | cSt | 19.06 | 115 |
| Aliphatic sulfur | wt % | 0.054 | 0.436 |
| Total $aromatics_{DO}$ | mmol/kg | 342.3 | 807.7 |
| 2 + ring $aromatics_{DO}$ | mmol/kg | 48.9 | 252.7 |
| 2 + $ring_{DO}/TA_{DO}$ | — | 0.14 | 0.36 |
| 2-ring $aromatics_{DO}$ | mmol/kg | 47.90 | 180.00 |
| 2-$ring_{DO}/TA_{DO}$ | — | 0.14 | 0.23 |
| $KV100_{DO}$ | ° C. | 3.92 | 12.31 |

In some embodiments, the diluent oil used for the additive package concentrate can include a Group I base oil, Group II base oil, Group III base oil, or a combination thereof, such as a Group I base oil, Group II base oil, or a combination thereof.

The additive package concentrates of the present disclosure can be prepared by dissolving the additive(s) in the diluent oil using well-known techniques.

The present disclosure also generally relates to finished lubricant formulations (or a "lubricating oil composition") that includes na additive package concentrate according to the present disclosure. In some embodiments, the finished lubricant formulations can also include a base oil (e.g., a Group I, Group II, Group III, Group IV, Group V base oil, or a combination thereof).

In some embodiments, a lubricating oil composition can be made from an additive package concentrate. In at least one embodiment, a method of forming a lubricating oil composition can include introducing a base oil (e.g., a Group I, Group II, Group III, Group IV, Group V base oil, or a combination thereof) to an additive package concentrate of the present disclosure (which can include one or more additives) to form a lubricating oil composition. The lubricating oil composition of the present disclosure can be prepared by blending the additive package concentrates in a base oil using well-known techniques. In at least one embodiment, a lubricating oil compositions can be made by the following method. The base oil used for the lubricating oil composition can be made of the same or different materials as the diluent oil used to make the additive package concentrate. In some embodiments, the lubricating oil composition can include an amount of a base oil (apart from the diluent oil in the additive package concentrate).

Additives

In some embodiments, the additive package concentrates and/or lubricating oil compositions useful in the present disclosure may contain one or more of other commonly used lubricating oil performance additives. Such additives can include, but are not limited to, extreme pressure additives, antioxidants, solubility additives, friction modifiers, anti-foam agent, dispersants, detergents, corrosion inhibitors, rust inhibitors, metal deactivators, anti-wear agents, anti-seizure agents, wax modifiers, viscosity index improvers, viscosity modifiers, fluid-loss additives, seal compatibility agents, lubricity agents, anti-staining agents, chromophoric agents, demulsifiers, emulsifiers, densifiers, wetting agents, gelling agents, tackiness agents, colorants, and others, and a combination thereof. For a review of many commonly used additives, see Klamann in Lubricants and Related Products, Verlag Chemie, Deerfield Beach, Fla.; ISBN 0-89573-177-0. Reference is also made to "Lubricant Additives Chemistry and Applications" edited by Leslie R. Rudnick, Marcel Dekker, Inc. New York, 2003 ISBN: 0-8247-0857-1; see also U.S. Pat. No. 7,704,930, the disclosure of which is incorporated herein in its entirety. The types and quantities of performance additives used in combination with the instant disclosure in lubricant compositions are not limited by the examples shown herein as illustrations.

Friction modifiers useful in this disclosure can be any materials that can alter the coefficient of friction of a surface lubricated by any lubricant or fluid containing such material(s). Organic friction modifiers, also known as friction reducers, or lubricity agents or oiliness agents, and other such agents that change the ability of base oils, formulated lubricant compositions, or functional fluids, to modify the coefficient of friction of a lubricated surface can be effectively used in combination with the base oils or lubricant compositions of the present disclosure. The organic friction modifiers can be sub-grouped into metal-containing organic complex friction modifiers and other organic friction modifiers, which are discussed below.

A. Metal-Containing Organic Complex Friction Modifiers

Metal-containing organic complex friction modifiers useful in this disclosure are any materials that can alter the coefficient of friction of a surface lubricated by any lubricant or fluid containing such material(s). Metal-containing organic complex friction modifiers, also known as friction reducers, or lubricity agents or oiliness agents, and other such agents that change the ability of base oils, formulated lubricant compositions, or functional fluids, to modify the coefficient of friction of a lubricated surface can be effectively used in combination with the base oils or lubricant compositions of the present disclosure. Metal-containing organic complex friction modifiers that lower the coefficient of friction are particularly advantageous in combination with the base oils and lube compositions of this disclosure.

Example metal-containing organic complex friction modifiers useful in the lubricating oil compositions of this disclosure can include tungsten organic complex compounds or molybdenum organic complex compounds. Illustrative tungsten or molybdenum organic complex compounds can include, for example, tungsten dithiophosphates or molybdenum dithiophosphates represented by the formula

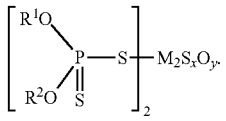

wherein M is tungsten or molybdenum, $R^1$ and $R^2$ are the same or different, each of $R^1$ and $R^2$ contains from 1 to 30 carbon atoms and are an alkyl group, a cycloalkyl group, an aryl group or an alkylaryl group, and x and y are positive real numbers satisfying the equation x+y=4. Other illustrative tungsten or molybdenum organic complex compounds can include, for example, tungsten or molybdenum dithiocarbamates represented by the formula

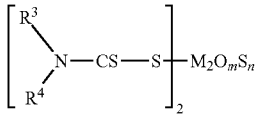

wherein M is tungsten or molybdenum, $R^3$ and $R^4$ are the same or different, each of $R^3$ and $R^4$ contains from 1 to 30 carbon atoms and are an alkyl group, a cycloalkyl group, an aryl group or an alkylaryl group, and m and n are positive real numbers satisfying the equation: m+n=4. Such a tungsten or molybdenum dithiocarbamate may be in the form of a dimer or trimer, being fully sulfurized or containing residual oxygen. Additionally, illustrative examples may include tungsten or molybdenum organic complexes such as amine-based salts of tungsten or molybdenum oxides and tungsten or molybdenum amine complexes.

Illustrative tungsten organic complex compounds useful in the lubricating oil compositions of this disclosure are described, for example, in U.S. Pat. Nos. 4,529,526 and 4,266,945, the disclosures of which are incorporated herein by reference. Other illustrative tungsten organic complex compounds useful in the lubricating oil compositions of this disclosure are described, for example, in U.S. Patent Application Publication Nos. 2004/0214731 and 2007/0042917, the disclosures of which are incorporated herein by reference.

If used, the metal-containing organic complex friction modifier can constitute a minor component of the lubricating oil composition of the present disclosure and can be present in an amount from about 0.01 wt % to about 5 wt %, such as from about 0.01 wt % to about 3.5 wt %4, such as from about 0.01 wt % to about 2.5 wt %, based on the total weight of the composition. The concentration of the metal-containing organic complex friction modifier can be sufficient to provide from about 20 parts per million (ppm) to about 500 ppm of metal (e.g., tungsten or molybdenum), such as from about 40 ppm to about 400 ppm of metal, such as from about 50 ppm to about 250 ppm of metal to the lubricating oil composition.

B. Other Organic Friction Modifiers

Illustrative other organic friction modifiers useful in the lubricating oil compositions of this disclosure can include, for example, an alkoxylated fatty acid ester, alkanolamide, glycerol fatty acid ester, borated glycerol fatty acid ester, fatty alcohol ether, and a combination thereof.

Illustrative alkoxylated fatty acid esters can include, for example, polyoxyethylene stearate, fatty acid polyglycol ester, and the like. These can include polyoxypropylene stearate, polyoxybutylene stearate, polyoxyethylene isosterate, polyoxypropylene isostearate, and polyoxyethylene palmitate.

Illustrative alkanolamides can include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, and polypropoxylated hydrocarbylamides.

Illustrative glycerol fatty acid esters can include, for example, glycerol mono-oleate, glycerol mono-stearate, and the like. These can include polyol esters and hydroxyl-containing polyol esters. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Other examples can include the glycerol mono-oleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be used as well as mixtures containing any of these. Ethoxylated, propoxylated, butoxylated fatty acid esters of polyols, such as using glycerol as underlying polyol can be employed.

Illustrative borated glycerol fatty acid esters can include, for example, borated glycerol mono-oleate, borated glycerol mono-sterate, and the like.

Illustrative fatty alcohol ethers can include, for example, stearyl ether, myristyl ether, and the like. Alcohols, including those that have carbon numbers from C=3 to C=50, can be ethoxylated, propoxylate, or butoxylated to form the corresponding fatty alkyl ethers. In at least one embodiment, the underlying alcohol portion can be stearyl, myristyl, $C_{11}$-$C_{13}$hydrocarbon, oleyl, isosteryl, and the like.

In at least one embodiment, organic friction modifiers of this disclosure can include an ethoxylated fatty acid ester and stearyl ether, isostearyl ether, or palmitic ether, and mixtures thereof. An example organic friction modifier mixture of this disclosure comprises an ethoxylated fatty acid ester and a stearyl ether.

In at least one embodiment, a formulation of this disclosure includes a Group I, Group II, Group III, Group IV and/or Group V base oil, a tungsten or molybdenum organic complex friction modifier, and an organic friction modifier comprising an ethoxylated fatty acid ester and/or a stearyl ether.

In some embodiments, an amount of organic friction modifiers can be from about 0.01 wt % to about 10-15 wt % or more, such as from about 0.05 wt % to about 5 wt %, or from about 0.1 wt % to about 2.5 wt % of the lubricating oil composition. In organic friction modifier mixtures, the weight ratio of the first friction modifier to the other friction modifier can be from about 0.1:1 to about 1:0.1.

Antiwear additives useful in lubricating oil compositions of the present disclosure can include a metal alkylthiophosphate, such as a metal dialkyl dithio phosphate in which the metal constituent is zinc, or zinc dialkyl dithio phosphate (ZDDP). ZDDP can be derived from primary alcohols, secondary alcohols or mixtures thereof. ZDDP compounds generally are of the formula $Zn[SP(S)(OR^1)(R^2)]_2$ where $R^1$ and $R^2$ are $C_1$-$C_{18}$ alkyl groups, such as $C_2$-$C_{12}$alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be used. Alkyl aryl groups may also be used.

Example zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

In at least one embodiment, the ZDDP can be used in an amount that is from about 0.4 wt % to about 1.2 wt %, such as from about 0.5 wt % to about 1.0 wt %, such as from about 0.6 wt % to about 0.8 wt %, based on the total weight of the lubricating oil, although more or less can often be used advantageously. In some embodiments, the ZDDP can be a secondary ZDDP and can be present in an amount that is from about 0.6 wt % to about 1.0 wt % of the total weight of the lubricating oil composition.

Illustrative detergents useful in this disclosure can include, for example, alkali metal detergents, alkaline earth metal detergents, or mixtures of one or more alkali metal detergents and one or more alkaline earth metal detergents. A typical detergent can be an anionic material that contains a long chain hydrophobic portion of the molecule and a smaller anionic or oleophobic hydrophilic portion of the molecule. The anionic portion of the detergent can be derived from an organic acid such as a sulfur acid, carboxylic acid, phosphorous acid, phenol, or mixtures thereof. The counterion can be an alkaline earth or alkali metal.

Salts that contain a substantially stochiometric amount of the metal are described as neutral salts and have a total base number (TBN, as measured by ASTM D2896) that is from 0 to 80. Many compositions can be overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Mixtures of low, medium, and high TBN can be used, along with mixtures of calcium and magnesium metal based detergents, and including sulfonates, phenates, salicylates, and carboxylates. In at least one embodiment, a detergent mixture with a metal ratio of about 1, in conjunction of a detergent with a metal ratio of about 2, and as high as a detergent with a metal ratio of about 5, can be used. Borated detergents can also be used.

Alkaline earth phenates are another useful class of detergent. These detergents can be made by reacting alkaline earth metal hydroxide or oxide (for example, CaO, $Ca(OH)_2$, BaO, $Ba(OH)_2$, MgO, $Mg(OH)_2$) with an alkyl phenol or sulfurized alkylphenol. Useful alkyl groups can include straight chain or branched $C_1$-$C_{30}$ alkyl groups, such as $C_4$-$C_{20}$ and/or mixtures thereof. Examples of suitable phenols can include isobutylphenol, 2-ethylhexylphenol, nonylphenol, dodecyl phenol, and the like. It should be noted that starting alkylphenols may contain more than one alkyl substituent that can be each independently straight chain or branched and can be used from about 0.5 wt % to about 6 wt %. In embodiments where a non-sulfurized alkylphenol is used, the sulfurized product may be obtained by methods known in the art. These methods can include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids can also be useful as detergents. These carboxylic acid detergents may be prepared by reacting a basic metal compound with at least one carboxylic acid and removing free water from the reaction product. These compounds may be overbased to produce the desired TBN level. Detergents made from salicylic acid can be one example class of detergents derived from carboxylic acids. Useful salicylates can include long chain alkyl salicylates. One useful family of compositions can be of the formula

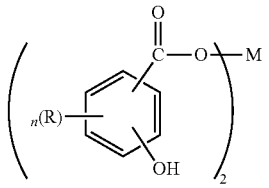

where R is an alkyl group having 1 to 30 carbon atoms, n is an integer from 1 to 4, and M is an alkaline earth metal. Example R groups are alkyl chains of $C_{11}$ or greater, such as $C_{13}$ or greater. R may be optionally substituted with substituents that do not interfere with the detergent's function. In some embodiments, M can be calcium, magnesium, or barium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Non-limiting examples of detergents can include calcium phenates, calcium sulfonates, calcium salicylates, magnesium phenates, magnesium sulfonates, magnesium salicylates and other related components (including borated detergents), and mixtures thereof. Non-limiting example mixtures of detergents can include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

In at least one embodiment, the lubricating oil composition of the present disclosure can include an amount of detergent that is from about 1 wt % to about 6 wt %, such as from about 1.5 wt % to about 5 wt %, such as from about 2 wt % to about 4 wt %, based on the total weight of the lubricating oil composition.

Antioxidants can be used to retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, and U.S. Pat. Nos. 4,798,684 and 5,084,197, for example.

Illustrative detergents useful in this disclosure can include, for example, hindered phenols. These phenolic antioxidants may be ashless (metal-free) phenolic compounds or neutral or basic metal salts of certain phenolic compounds. Typical phenolic antioxidant compounds can be the hindered phenolics which are the ones containing a sterically hindered hydroxyl group, and these can include those derivatives of dihydroxy aryl compounds in which the hydroxyl groups are in the o- or p-position to each other. Phenolic antioxidants can include the hindered phenols substituted with $C_{6+}$ alkyl groups and the alkylene coupled derivatives of these hindered phenols. Examples of phenolic materials of this type include 2-t-butyl-4-heptyl phenol, 2-t-butyl-4-octyl phenol, 2-t-butyl-4-dodecyl phenol, 2,6-di-t-butyl-4-heptyl phenol, 2,6-di-t-butyl-4-dodecyl phenol, 2-methyl-6-t-butyl-4-heptyl phenol, and 2-methyl-6-t-butyl-4-dodecyl phenol. Other useful hindered mono-phenolic antioxidants may include, for example, hindered 2,6-di-alkyl-phenolic propionic ester derivatives. Bis-phenolic antioxidants may also be used in combination with the instant disclosure.

Examples of ortho-coupled phenols can include 2,2'-bis(4-heptyl-6-t-butyl-phenol), 2,2'-bis(4-octyl-6-t-butyl-phenol), and 2,2'-bis(4-dodecyl-6-t-butyl-phenol). Examples of para-coupled bisphenols can include 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Example non-phenolic oxidation inhibitors can include aromatic amine antioxidants and these may be used either as such or in combination with phenolics. Typical examples of non-phenolic antioxidants can include alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}(O)_xR^{12}$ where $R^{11}$ is an alkylene, alkenylene, or aralkylene group, $R^{12}$ is a higher alkyl group, or an alkenyl, aryl, or alkaryl group, and x is 0, 1, or 2. The aliphatic group $R^8$ may contain from 1 to 20 carbon atoms, such as from 6 to 12 carbon atoms. The aliphatic group can be a saturated aliphatic group. In some examples, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Example aromatic amines antioxidants can have alkyl substituent groups of at least 6 carbon atoms. Examples of aliphatic groups include hexyl, heptyl, octyl, nonyl, and decyl. In some examples, the aliphatic groups contain 14 or fewer 14 carbon atoms. The general types of amine antioxidants useful in the present compositions can include diphenylamines, phenyl naphthylamines, phenothiazines, imidodibenzyls, and diphenyl phenylene diamines. Mixtures of two or more aromatic amines can be used. Polymeric amine antioxidants can also be used. Other non-limiting examples of aromatic amine antioxidants useful in the present disclosure can include p,p-dioctyldiphenylamine, t-octylphenyl-alpha-naphthylamine, phenyl-alphanaphthylamine, and p-octylphenyl-alpha-naphthylamine.

Sulfurized alkyl phenols and alkali or alkaline earth metal salts thereof also are useful antioxidants.

In some embodiments, the antioxidant can include hindered phenols, arylamines, or a combination thereof.

In at least one embodiment, the lubricating oil composition of the present disclosure can include an amount of antioxidant that is from about 0.01 wt % to about 10 wt %, such as from about 0.05 wt % to about 5 wt %, such as from about 1 wt % to about 4 wt %, such as from about 2 wt % to about 3.5 wt %, based on the total weight of the lubricating oil composition.

Pour point depressants (also known as lube oil flow improvers) may be added to the lubricating oil compositions of the present disclosure if desired. These pour point depressants may be added to lubricating compositions of the present disclosure to lower the minimum temperature at which the fluid will flow or can be poured. Examples of suitable pour point depressants can include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof.

In at least one embodiment, the lubricating oil composition of the present disclosure can include an amount of pour point depressant that is from about 0.01 wt % to about 5 wt %, such as from about 0.05 wt % to about 1.5 wt %, based on the total weight of the lubricating oil composition.

Seal compatibility agents can help to swell elastomeric seals by causing a chemical reaction in the fluid or physical change in the elastomer. Suitable seal compatibility agents for lubricating oils can include organic phosphates, aromatic esters, aromatic hydrocarbons, esters (butylbenzyl phthalate, for example), and polybutenyl succinic anhydride.

In at least one embodiment, the lubricating oil composition of the present disclosure can include an amount of seal compatibility agent that is from about 0.01 wt % to about 3 wt %, such as from about 0.05 wt % to about 2 wt %, based on the total weight of the lubricating oil composition.

Anti-foam agents can be added to the lubricating oil compositions. Antifoam agents can retard the formation of stable foams. Example anti-foam agents include silicones and organic polymers. For example, polysiloxanes, such as silicon oil or polydimethyl siloxane, provide antifoam properties. Anti-foam agents are commercially available and may be used in conventional minor amounts along with other additives such as demulsifiers. In at least one embodiment, the amount of these additives combined can be less than about 1 wt %, such as about 0.1 wt % or less, based on the total weight of the lubricating oil composition.

Antirust additives (or corrosion inhibitors) are additives that can protect lubricated metal surfaces against chemical attack by water or other contaminants. A wide variety of these are commercially available.

Useful antirust additives include: polar compounds that wet the metal surface preferentially and protect it with a film of oil, additives that can absorb water by incorporating it in a water-in-oil emulsion so that only the oil touches the metal surface; and additives that can chemically adhere to the metal to produce a non-reactive surface. Non-limiting examples of suitable additives include zinc dithiophosphates, metal phenolates, basic metal sulfonates, fatty acids, amines, and a combination thereof. In at least one embodiment, the lubricating oil composition of the present disclosure can include an amount of inhibitor and/or anti-rust additive that is from about 0.01 wt % to about 1.5 wt %, such as from about 0.05 wt % to about 1 wt %, based on the total weight of the lubricating oil composition.

When lubricating oil compositions contain one or more of the additives discussed above, the additive(s) can be blended into the composition in an amount sufficient for it to perform its intended function.

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

Example Diluent Oils

Oils of lubricating viscosity useful as the diluents of the present disclosure may be selected from natural oils, synthetic oils, and unconventional oils, and/or mixtures thereof, and can be used unrefined, refined, or rerefined (the latter is also known as reclaimed or reprocessed oil). Unrefined oils can include those obtained directly from a natural or synthetic source and used without added purification. These can include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes can include solvent extraction, secondary distillation, acid extraction, base extraction, filtration, and percolation. Rerefined oils include those obtained by processes analogous to refined oils but using an oil that has been previously used as a feed stock.

Natural oils can include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale can also serve as useful base oils.

Synthetic lubricating oils can include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., can constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils can include the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Non-limiting examples of such esters can include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils can also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils can comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils can include liquid esters of phosphorous-containing acids (e.g., tricresyl phosphate, trioctyl phosphate, diethyl ester of decylphosphonic acid) and polymeric tetrahydrofurans.

The diluent oil can include a Group I, Group II, Group III, Group IV, or Group V oil or blends of the aforementioned oils. The diluent oil can also include a blend of a Group I oil and one or more of Group II, Group III, Group IV, or Group V oil. In some embodiments, the diluent oil can be a mixture of a Group I oil and one or more a Group II, Group III, Group IV or Group V oil, such as a mixture of a Group I oil and one or more Group II or Group III oil.

Definitions for the oils as used herein are the same as those found in the American Petroleum Institute (API) publication "Engine Oil Licensing and Certification System", Industry Services Department, Fourteenth Edition, December 1996, Addendum 1, December 1998. Group I base oils have a viscosity index of between 80 to 120 and contain greater than 0.03% sulfur and/or less than 90% saturates. Group II base oils have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base oil includes base oils not included in Groups I-IV. The table below summarizes properties of each of these five groups. The table below summarizes properties of each of these five groups.

| | Base Oil Properties | | |
|---|---|---|---|
| Group | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | polyalphaolefins (PM)) | | |
| Group V | All other base oil stocks not included in Groups I, II, III or IV | | |

EXAMPLES

Example 1. Example Viscosity Modifier Concentrates and Example Finished Lubricant Formulations The performance of EHC™ 45 as a viscosity modifier diluent oil was evaluated against comparative Group I and Group II viscosity modifier diluent oils—ExxonMobil Americas Core™ 150 (Group I), Motiva Star™ 4 (Group II) and Flint Hills Resources™ 100-HC (Group II). The results from the testing described below indicated that EHC™ 45 exhibited performance superior to Group I and Group II base oils traditionally used as viscosity modifier diluent oils. As a viscosity modifier diluent oil, EHC 45™ effected a greater increase in viscosity at high temperature and less viscosity increase at low temperature. As a result, the formulations prepared using the viscosity modifier diluted with EHC™ 45 required the lowest viscosity modifier treat rates and, where applicable, the least amount of Group III base oil. Both viscosity modifier and Group III base oil contribute significantly to the finished lubricant cost; therefore, there is an economic advantage to minimizing their treat in a finished lubricant formulation. The results of the evaluation demonstrate that, when used as the viscosity modifier diluent oil, EHC™ 45 achieved these objectives better than traditional viscosity modifier diluent oils.

Viscosity modifier diluent oil performance was assessed by comparing the viscosity modifier treat rate and diluent oil mix required to meet a target finished lubricant kinematic viscosity and cold cranking simulator (CCS) viscosity. Viscosity modifier treat rate is the percentage of viscosity modifier in the finished lubricant.

The performance of Flint Hills Resources™ 100-HC was not evaluated directly as it is believed it would perform similarly to the Motiva Star™ 4 diluent oil due to the similarities in their viscometric properties. The inspection data for each diluent oil is provided in Table 1.

TABLE 1

| Property | Test Method | Core ™ 150 | EHC ™ 45 | Star ™ 4 | 100-HC ™ |
|---|---|---|---|---|---|
| Density at 15° C., g/mL | ASTM D4052 | 0.8703 | 0.8436 | 0.8518 | 0.8540 |
| Kinematic Viscosity at 100° C., cSt | ASTM D445 | 5.155 | 4.63 | 4.101 | 4.153 |
| Kinematic Viscosity at 40° C., cSt | ASTM D445 | 30.68 | 23.29 | 19.93 | 20.7 |
| Viscosity Index | ASTM D2270 | 95 | 116 | 105 | 101 |
| CCS Viscosity at −25° C., mPa · s | ASTM D5293 | — | 1395 | 1310 | 1417 |
| CCS Viscosity at −25° C., mPa · s | ASTM D5293 | 2034 | — | — | — |

The viscosity modifier concentrates were prepared with Paratone™ 8941, a solid ethylene-propylene copolymer manufactured by Chevron Oronite. Paratone™ 8941, in the form of several large chunks, was cut into small pieces (about 0.5 cm square) using metal snips to facilitate dispersion and dissolution of the solid polymer in the diluent oil.

The viscosity modifier concentrates were prepared in batches of 500 g comprised of 6.3 wt % of the polymer diluted in 93.7 wt % of the diluent oil. Each batch of viscosity modifier concentrate was prepared in a 1.2 L Griffin-style stainless steel beaker (10.5 cm×15.4 cm, diameter×height). The polymer and diluent oil were added, by weight, to the beaker that was then covered with a stainless steel cover that was fitted with a nitrogen purge line. There was a centrally bored opening in the cover to accommodate the stirrer shaft and a smaller diameter opening bored about 0.5 inches from the edge of the cover to accommodate the temperature probe. The stirrer is a stainless steel crossed blade (5.0 cm diameter) impeller welded to an 8 mm diameter shaft. The impeller blades were positioned approximately 1 inch from the bottom of the beaker during mixing. Mixing was accomplished using a low shear overhead stirrer and temperature control was provided by a heating mantle and thermocouple attached to a digital controller. All mixing was conducted in a fume hood. The set point of the temperature controller and the speed of the stirrer were increased incrementally to prevent the temperature of the mixture from over-shooting the target and to compensate for the increase in the viscosity of the mixture that occurred as the polymer dissolved in the base oil. The temperature and speed ramp details used for the viscosity modifier concentrate preparation are summarized in Table 2. A nitrogen blanket of 2-5 psi was used throughout the duration of mixing to prevent oxidation of the diluent oil at the blend temperature.

TABLE 2

| Elapsed Time, h:min | Segment Time, h:min | Temperature Set Point, ° C. | Stirrer Speed Setting, rpm |
|---|---|---|---|
| 0:20 | 0:20 | 100 | 75 |
| 0:30 | 0:10 | 115 | 75 |
| 0:40 | 0:10 | 120 | 75 |
| 0:45 | 0:05 | 125 | 75 |
| 1:25 | 0:40 | 130 | 75 |
| 2:25 | 1:00 | 130 | 100 |
| 3:25 | 1:00 | 130 | 150 |
| 5:25 | 2:00 | 130 | 200 |

The composition and kinematic viscosity of each viscosity modifier concentrate is shown in Table 3. The active polymer content in the viscosity modifier concentrate was maintained constant in all viscosity modifier concentrates, so as to evaluate the impact of the diluent oil quality alone in this study. In addition to kinematic viscosity, the viscosity modifier concentrates were visually examined to detect differences in haze which may have indicated insufficient solubility of the polymer in the diluent oil. No significant difference in haze was observed in the neat viscosity modifier concentrates when compared side-by-side. There was also no discernable difference in the appearance of the 5W-30 formulations prepared from each viscosity modifier concentrate.

TABLE 3

| | EHC ™ 45 | Core ™ 150 | Star ™ 4 |
|---|---|---|---|
| Component | Component Treat, wt % | | |
| Paratone ™ 8941 | 6.3 | 6.3 | 6.3 |
| EHC ™ 45 | 93.7 | — | — |
| Core ™ 150 | — | 93.7 | — |
| Star ™ 4 | — | — | 93.7 |
| Kinematic Viscosity at 100° C., cSt (ASTM D445) | 1718 | 1466 | 2256 |

The performance of each viscosity modifier concentrate was evaluated in market general passenger car (PCEO) and heavy duty (HDEO) engine oil formulations that covered Society of Automotive Engineers (SAE) viscosity grades 0W, 5W, 10W and 15W. Two 5W formulations were included in the performance assessment to show differentiation with and without the use of a Group III base oil. For each formulation, adjustments were made to the VM treat rate and base oil viscosity (BOV) to align the finished lubricant kinematic viscosity at 100° C. and cold cranking simulator viscosity at the temperature specified for the viscosity grade of the formulation. In general, the kinematic viscosity was adjusted to be in the middle of the range specified for the formulation viscosity grade and the BOV was adjusted to give a CCS viscosity of approximately 300 cP below the maximum specified for the formulation viscosity grade. These adjustments maximized the performance differentiation and reflected the formulation optimization that would be carried out by a finished lubricant blender. For a given formulation, the additive package and treat rate were held constant.

For comparison, the same viscosity modifier concentrates were used for all formulations.

The diluent oil performance of the viscosity modifier concentrate in the 0W-20 market general PCEO formulation is shown in Table 4. As shown in Table 4, the viscosity modifier diluted with EHC™ 45 required a lower treat to meet the finished lubricant kinematic viscosity target than the viscosity modifier diluted with traditional Group II or Group I base oil. In addition to superior thickening efficiency at high temperature, the viscosity modifier diluted with EHC™ 45 caused less thickening at low temperature than the viscosity modifier diluted with Group I base oil. Thus, with EHC™ 45 as the viscosity modifier diluent oil, a higher BOV was achievable which permitted the use of less Group III base oil in the base oil mix.

TABLE 4

VM Diluent Oil Performance in 0W-20 PCEO

| Viscosity Modifier Diluent Oil | EHC ™ 45 | Star ™ 4 | Core ™ 150 |
|---|---|---|---|
| Finished Lubricant Kinematic Viscosity at 100° C., cSt (ASTM D445) | 8.353 | 8.334 | 8.324 |
| Base Oil Kinematic Viscosity at 100° C., cSt (ASTM D445) | 4.396 | 4.374 | 4.329 |
| Finished Lubricant CCS Viscosity at −35° C., mPa · s (ASTM D5293) | 5894 | 5796 | 5772 |
| | Finished Lubricant Component Treat, wt % | | |
| EHC ™ 45 | 32.75 | 27.75 | 17.25 |
| Group III base oil, Yubase ™ 4 | 51.65 | 56.35 | 67.10 |
| Additive Package, OLOA 55503 | 9.60 | 9.60 | 9.60 |
| Paratone ™ 8941 | 6.00 | 6.30 | 6.05 |

The viscosity modifier diluent oil performance in the 5W-30 market general PCEO formulations with and without Group III in the base oil mix is shown in Table 5 and Table 6, respectively. As with the 0W formulation, the viscosity modifier diluted with EHC™ 45 met the finished lubricant viscosity targets at a lower treat and higher BOV than the viscosity modifier diluted with traditional Group II or Group I base oil. As a result, where applicable, less Group III base oil was needed to balance the formulation.

TABLE 5

Viscosity Modifier Diluent Oil Performance in 5W-20 PCEO - With Group III Base Oil

| Viscosity Modifier Diluent Oil | EHC ™ 45 | Star ™ 4 | Core ™ 150 |
|---|---|---|---|
| Finished Lubricant Kinematic Viscosity at 100° C., cSt (ASTM D445) | 11.42 | 11.42 | 11.57 |
| Base Oil Kinematic Viscosity at 100° C., cSt (ASTM D445) | 5.199 | 50.25 | 5.199 |
| Finished Lubricant CCS Viscosity at −30° C., mPa · s (ASTM D5293) | 6311 | 5958 | 6519 |
| | Finished Lubricant Component Treat, wt % | | |
| Traditional Group II base oil, Motiva Star ™ 6 | 42.09 | 39.16 | 38.90 |
| Group III base oil, Yubase ™ 4 | 40.00 | 42.49 | 43.00 |

TABLE 5-continued

Viscosity Modifier Diluent Oil Performance in 5W-20 PCEO - With Group III Base Oil

| Viscosity Modifier Diluent Oil | EHC ™ 45 | Star ™ 4 | Core ™ 150 |
|---|---|---|---|
| Additive Package, OLOA 55503 | 9.60 | 9.60 | 9.60 |
| Paratone ™ 8941 | 8.31 | 8.75 | 8.50 |

TABLE 6

Viscosity Modifier Diluent Oil Performance in 5W-30 PCEO - With Group III Base Oil

| Viscosity Modifier Diluent Oil | EHC ™ 45 | Star ™ 4 | Core ™ 150 |
|---|---|---|---|
| Finished Lubricant Kinematic Viscosity at 100° C., cSt (ASTM D445) | 11.58 | 11.56 | 11.46 |
| Base Oil Kinematic Viscosity at 100° C., cSt (ASTM D445) | 5.219 | 5.192 | 5.031 |
| Finished Lubricant CCS Viscosity at −30° C., mPa · s (ASTM D5293) | 6294 | 6238 | 6118 |
| | Finished Lubricant Component Treat, wt % | | |
| EHC ™ 45 | 52.10 | 53.10 | 60.59 |
| EHC ™ 65 | 29.90 | 28.50 | 21.33 |
| Additive Package, OLOA 55503 | 9.60 | 9.60 | 9.60 |
| Paratone ™ 8941 | 8.40 | 8.80 | 8.48 |

The viscosity modifier diluent oil performance in the 10W-30 market general PCEO formulation is shown in Table 7. The viscosity modifier diluted with EHC™ 45 required a lower viscosity modifier treat to meet the finished lubricant kinematic viscosity target than the viscosity modifier diluted with traditional Group II or Group I base oil.

TABLE 7

Viscosity Modifier Diluent Oil Performance in 10W-30 PCEO

| Viscosity Modifier Diluent Oil | EHC ™ 45 | Star ™ 4 | Core ™ 150 |
|---|---|---|---|
| Finished Lubricant Kinematic Viscosity at 100° C., cSt (ASTM D445) | 11.22 | 11.24 | 11.18 |
| Base Oil Kinematic Viscosity at 100° C., cSt (ASTM D445) | 6.207 | 6.207 | 6.054 |
| Finished Lubricant CCS Viscosity at −25° C., mPa · s (ASTM D5293) | 6139 | 6123 | 5985 |
| | Finished Lubricant Component Treat, wt % | | |
| EHC ™ 45 | 10.73 | 10.69 | 16.60 |
| EHC ™ 65 | 74.08 | 73.84 | 68.10 |
| Additive Package, OLOA 55503 | 9.60 | 9.60 | 9.60 |
| Paratone ™ 8941 | 5.59 | 5.87 | 5.70 |

The viscosity modifier diluent oil performance in the 10W-30 market general HDEO formulation is shown in Table 8. As with the 10W-30 PCEO formulation, the finished lubricant kinematic viscosity target was met at a lower viscosity modifier treat when the viscosity modifier diluent oil was EHC™ 45 versus traditional Group II or Group I base oil.

TABLE 8

| Viscosity Modifier Diluent Oil | EHC ™ 45 | Star ™ 4 | Core ™ 150 |
|---|---|---|---|
| Viscosity Modifier Diluent Oil Performance in 10W-30 HDEO | | | |
| Finished Lubricant Kinematic Viscosity at 100° C., cSt (ASTM D445) | 11.88 | 11.90 | 11.92 |
| Base Oil Kinematic Viscosity at 100° C., cSt (ASTM D445) | 5.88 | 5.869 | 5.757 |
| Finished Lubricant CCS Viscosity at −25° C., mPa · s (ASTM D5293) | 5742 | 5718 | 5755 |
| | Finished Lubricant Component Treat, wt % | | |
| EHC ™ 45 | 22.26 | 22.62 | 27.04 |
| EHC ™ 65 | 57.69 | 57.05 | 52.78 |
| Additive Package, Lubrizol CV1100 | 14.20 | 14.20 | 14.20 |
| Paratone ™ 8941 | 5.85 | 6.13 | 5.98 |

The viscosity modifier diluent oil performance in the 15W40 market general HDEO formulation is shown in Table 9. As with the 10W-30 HDEO formulation, the finished lubricant kinematic viscosity target was met at a lower viscosity modifier treat when the viscosity modifier diluent oil was EHC™ 45 versus traditional Group II or Group I base oil.

TABLE 9

| Viscosity Modifier Diluent Oil | EHC ™ 45 | Star ™ 4 | Core ™ 150 |
|---|---|---|---|
| Viscosity Modifier Diluent Oil Performance in 15W-40 HDEO | | | |
| Finished Lubricant Kinematic Viscosity at 100° C., cSt (ASTM D445) | 14.39 | 14.44 | 14.46 |
| Base Oil Kinematic Viscosity at 100° C., cSt (ASTM D445) | 7.27 | 7.26 | 7.136 |
| Finished Lubricant CCS Viscosity at −25° C., mPa · s (ASTM D5293) | 5834 | 5845 | 5837 |
| | Finished Lubricant Component Treat, wt % | | |
| EHC ™ 65 | 59.77 | 59.82 | 64.76 |
| EHC ™ 100 | 19.95 | 19.63 | 14.77 |
| Additive Package, OLOA 55503 | — | 14.20 | 14.20 |
| Additive Package, Lubrizol CV1100 | 14.20 | — | — |
| Paratone ™ 8941 | 6.08 | 6.35 | 6.27 |

In all formulations it was found that the viscosity modifier diluted with EHC™ 45 effected a greater increase in kinematic viscosity than the viscosity modifier diluted with traditional Group II or Group I base oil and contributed less to low temperature thickening than the viscosity modifier diluted with a Group I base oil. Thus, for a given formulation, the viscosity modifier treat rate was lowest and the base oil viscosity was highest when the viscosity modifier diluent oil was EHC™ 45. These results demonstrate the economic benefit of using EHC™ 45 as a viscosity modifier diluent oil due to costs saved by reducing both viscosity modifier treat and Group III base oil treat.

The performance of EHC™ 45 as a viscosity modifier diluent oil exhibited differentiation from traditional Group I and Group II viscosity modifier diluent oils on the basis of viscosity modifier treat rate and finished lubricant BOV in both PCEO and HDEO finished lubricant formulations. The formulations that were prepared using the viscosity modifier diluted with EHC™ 45 were able to be optimized to have the lowest viscosity modifier treat rates and highest BOVs. Due to the high cost of viscosity modifier additives and low viscosity Group III base oils, minimizing viscosity modifier treat rates and maximizing BOVs can benefit lubricant blenders by significantly lowering the overall finished lubricant cost.

For the Figures described below, kinematic viscosity at 100° C. (KV100) was measured according to ASTM D445. Aniline point was measured according to ASTM D611. Aromatic content of the base oils was measured according to ASTM D7419. Turbidity was measured according to a suitable ASTM method or equivalent method. High temperature high shear (HTHS) viscosity (at 150° C.) was measured according to ASTM D4683. CCS Viscosity was measured according to ASTM D5293. Mini-rotary viscosity (MRV) was measured according to ASTM D4684.

FIG. 1A is a plot of kinematic viscosity at 100° C. (KV100) versus aniline point of example viscosity modifier concentrates made of 4 cSt diluent oils, 5 cSt diluent oils and EHC™ 45. The viscosity modifier for each example is Paratone™ 8941.

Figure 1B:
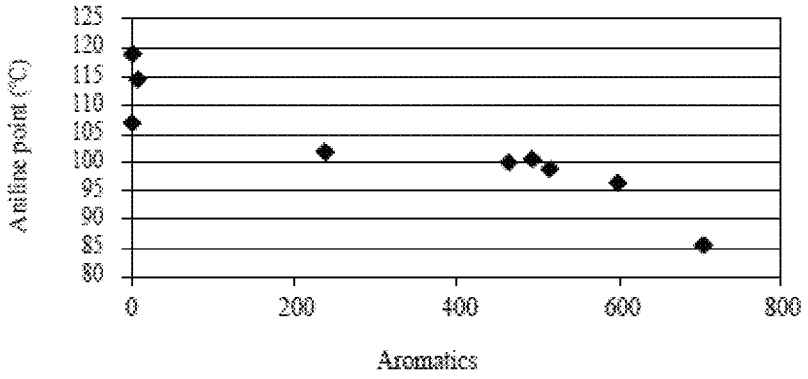
FIG. 1B is a plot of aniline point versus aromatic content for various Group I and Group II base oils.

FIG. 1A illustrates that the KV100 of the viscosity modifier concentrate varies linearly with aniline point at constant base oil viscosity. FIG. 1B is a plot of aniline point (° C.) versus aromatic content (mmol/kg) for various Group I and Group II base oils. This figure illustrates that aniline point is related to aromatic content of the base oils.

Figure 2:
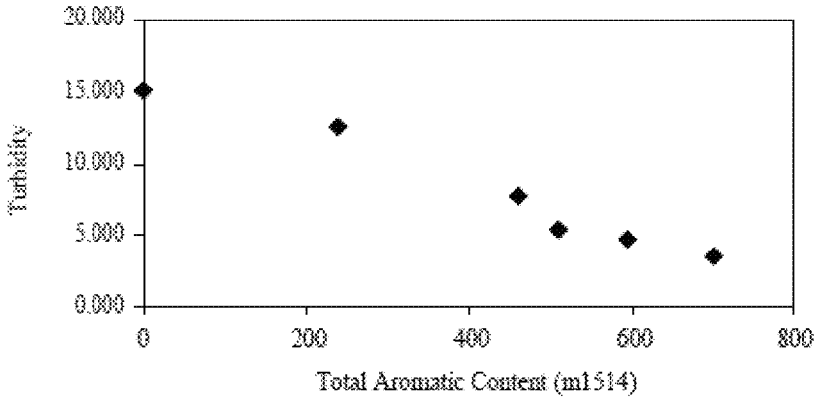
FIG. 2 is a plot of turbidity versus total aromatic content for example viscosity modifier concentrates according to at least one embodiment of the present disclosure.

FIG. 2 is a plot of turbidity versus total aromatic content (mmol/kg) for example viscosity modifier concentrates. FIG. 2 illustrates that turbidity is a function of total aromatic content.

Figure 3:
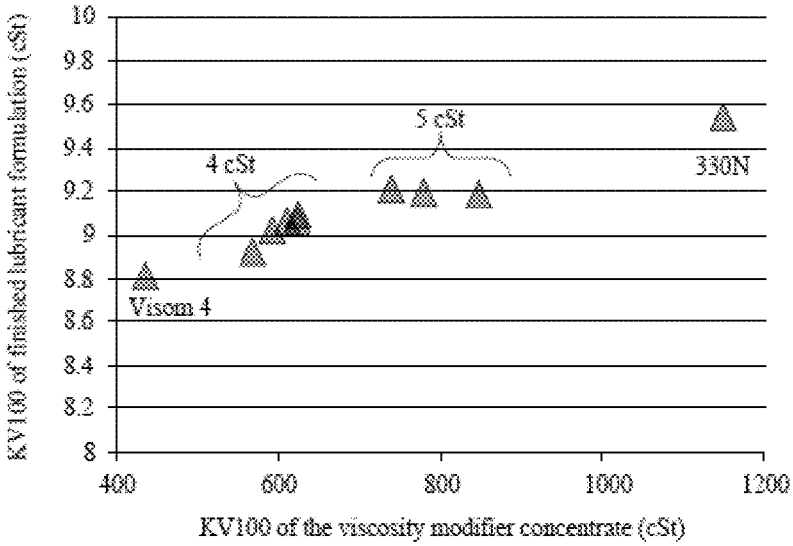
FIG. 3 is a plot of the KV100 of example finished lubricant formulations versus the KV100 of example viscosity modifier concentrates according to at least one embodiment of the present disclosure.

FIG. 3 is a plot of the KV100 of the example finished lubricant formulations versus the KV100 of the example viscosity modifier concentrates. Finished lubricant formulations examples were made from the viscosity modifier example concentrates. Each of the finished lubricant formulations included 8.3 wt % of the respective viscosity modifier concentrate, 65.5 wt % of EHC™ 65, 17 wt % of EHC™ 100, 8.9 wt % of INFINEUM™ P5061, and 0.3 wt % of INFINEUM™ V385. Surprisingly, and as shown in FIG. 3, when blended in a formulation (Mobil Drive Clean 5W-30) at 8.3 wt %, the KV100 of the example finished lubricant formulations is affected by the viscosity of the viscosity modifier concentrate.

Figure 4:
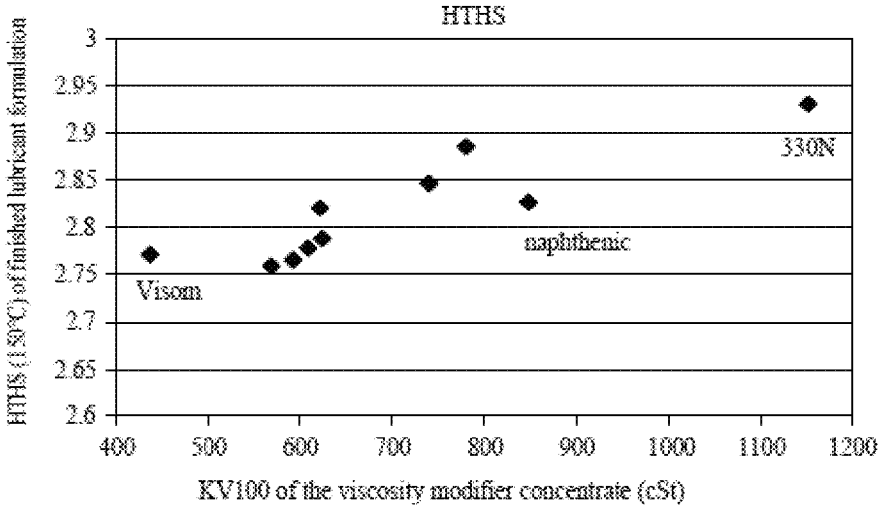
FIG. 4 is a plot of high temperature high shear (HTHS) viscosity (at 150° C.) of example finished lubricant formulations versus the KV100 of the example viscosity modifier concentrates according to at least one embodiment of the present disclosure.

FIG. 4 is a plot of high temperature high shear (HTHS, units of mPa·s) viscosity (at 150° C.) of the example finished lubricant formulations versus the KV100 of the example viscosity modifier concentrates. FIG. 4 illustrates that the HTHS viscosity of the finished lubricant formulations is also surprisingly affected by the viscosity of the viscosity modifier concentrate. Here, the HTHS of the finished lubricant formulations increases with the KV100 of the example viscosity modifier concentrates.

Figure 5:
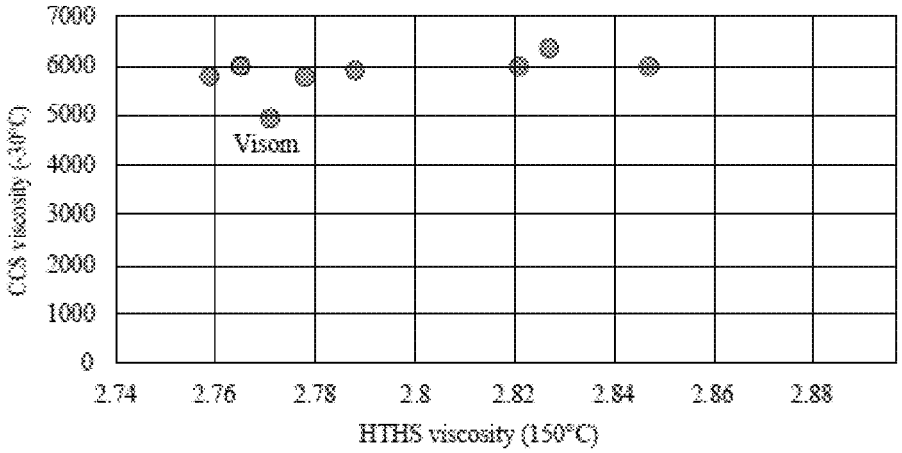
FIG. 5 is a plot of CCS viscosity (at −30° C.) versus HTHS viscosity (at 150° C.) of example finished lubricant formulations according to at least one embodiment of the present disclosure.
Figure 6:
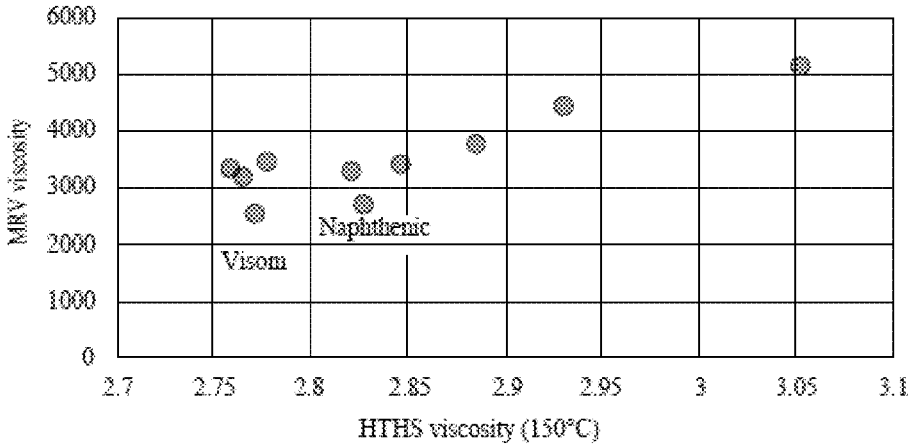
FIG. 6 is a plot of mini-rotary viscosity (MRV) versus HTHS viscosity (at 150° C.) of example finished lubricant formulations according to at least one embodiment of the present disclosure.

FIG. 5 is a plot of CCS viscosity (at −30° C., units of mPa s) versus HTHS viscosity (at 150° C., units of millipascal-seconds, mPa·s) of the example finished lubricant formulations. The plot shows that the CCS viscosity varies little with HTHS viscosity. FIG. 6 is a plot of mini-rotary viscosity (MRV, units of mPa·s) versus HTHS viscosity (at 150° C., units of mPa·s) of the example finished lubricant formulations. FIG. 6 illustrates that MRV viscosity increases above an HTHS of 2.86.

Example 2. Example Diluent Oils for Additive Package Concentrates

Table 10 summarizes calculated aniline point and TOST based on multiple regression of certain base oil properties (Equation 2 and Equation 3) for Americas Core™ 100, Americas Core™ 150, and Americas Core™ 600. Americas Core™ 100, 150, and 600 are Group I base oils commercially available from ExxonMobil. In Table 10, calculated values denoted by (x) represent an improvement in solubility and/or oxidation stability based on changes in total aromatics, 2+ring aromatics, and/or aliphatic sulfur content changes. Calculated values denoted by (y) represent a decline in solubility and/or oxidation stability based on changes in total aromatics, 2+ring aromatics, and/or aliphatic sulfur content changes.

TABLE 10

| Base Oil | KV 40° C. (cSt ) | Total Aromatics (mmol/kG) | 2 + ring Aromatics (mmol/kg) | Aliphatic Sulfur (wt %) | Calculated Aniline Point (° C.) | Calculated TOST (h) |
|---|---|---|---|---|---|---|
| Core ™ 100 | 20.4 | 348.7 | 48.9 | 0.08 | 102.75 | 3352.26 |
| Core ™ 100 | 20.4 | 581.7 | 102.0 | 0.08 | 99.24 (x) | 2994.04 (y) |
| Core ™ 100 | 20.4 | 581.7 | 102.0 | 0.17 | 98.17 (x) | 3190.21 (x) |
| Core ™ 100 | 20.4 | 581.7 | 102.0 | 0.25 | 97.29 (x) | 3353.35 (x) |
| Core ™ 150 | 30.5 | 379.1 | 89.3 | 0.12 | 103.34 | 2474.77 |
| Core ™ 150 | 30.5 | 635.9 | 154.6 | 0.12 | 99.49 (x) | 2393.49 (y) |
| Core ™ 150 | 30.5 | 635.9 | 154.6 | 0.19 | 98.71 (x) | 2535.97 (x) |
| Core ™ 150 | 30.5 | 635.9 | 154.6 | 0.75 | 98.03 (x) | 2661.94 (x) |
| Core ™ 600 | 112.2 | 411.1 | 137.4 | 0.17 | 114.94 | 1569.35 |
| Core ™ 600 | 112.2 | 652.7 | 235.3 | 0.17 | 111.30 (x) | 1301.27 (y) |
| Core ™ 600 | 112.2 | 652.7 | 235.3 | 0.28 | 110.08 (x) | 1526.35 (x) |
| Core ™ 600 | 112.2 | 652.7 | 235.3 | 0.35 | 109.30 (x) | 1670.90 (x) |

Analysis using regression of Group I base oils' properties demonstrated improved solubility (by measure of aniline point) and oxidation stability (by measure of TOST performance) when aliphatic sulfur increases. This relationship illustrates that while solubility can be improved by increasing aromatic content, the oxidation stability can be kept uncompromised by subsequently increasing the aliphatic sulfur content. Furthermore, Table 10 illustrates the calculated aniline point and TOST (oxidation) based on changes in total aromatics, 2+aromatics, and aliphatic sulfur. It is noted that as the aromatics content increases, the aniline point decreases and the oxidation stability decreases. However, if there is an increase in the aliphatic sulfur, the aniline point can continue to decrease, and oxidation stability can improve.

EMBODIMENTS LISTING

The present disclosure provides, among others, the following aspects, each of which may be considered as optionally including any alternate aspects.

Clause 1. A method of forming a viscosity modifier concentrate, comprising:

selecting a viscosity modifier for the viscosity modifier concentrate;

selecting a diluent oil to combine with the viscosity modifier based on the equation:

$$KV100_{VMC}=(130.3*KV100_{DO})-(4.5*\text{aniline point}_{DO})+532;\text{ and}$$

introducing the viscosity modifier to the diluent oil to form the viscosity modifier concentrate, wherein:

$KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline $point_{DO}$ is the aniline point of the diluent oil as measured according to ASTM D611, the aniline $point_{DO}$ being from about 95° C. to about 130° C.

Clause 2. The method of Clause 1, wherein the $KV100_{VMC}$ is from about 1000 cSt to about 2000 cSt.

Clause 3. The method of Clause 1 or Clause 2, wherein the diluent oil comprises a Group I base oil, a Group II base oil, a Group III base oil, or a combination thereof.

Clause 4. The method of any one of Clauses 1-3, wherein the diluent oil comprises a Group I base oil, a Group II base oil, or a combination thereof.

Clause 5. The method of any one of Clauses 1-4, wherein the diluent oil has one or more of the following properties:

a KV40 that is from about 15 cSt to about 31 cSt as determined according to ASTM D445;

the aniline $point_{DO}$ being from about 95° C. to about 110° C. as measured according to ASTM D611;

an aliphatic sulfur content that is from about 0 wt % to about 0.3 wt %;

a total aromatics content that is from about 0 mmol/kg to about 600 mmol/kg as measured according to ASTM D7419; or a viscosity index that is from 80 to 120 as measured according to ASTM D2270.

Clause 6. A viscosity modifier concentrate comprising:

a viscosity modifier; and a diluent oil, the diluent oil characterized by the equation:

$$KV100_{VMC}=(130.3*KV100_{DO})-(4.5*\text{aniline point}_{DO})+532,$$

wherein:

$KV100_{VMC}$ is the kinematic viscosity at 100° C. of the viscosity modifier concentrate in units of cSt, the $KV100_{VMC}$ being from about 400 cSt to about 2500 cSt $KV100_{DO}$ is the kinematic viscosity at 100° C. of the diluent oil as measured according to ASTM D445, the $KV100_{DO}$ being from about 3.9 cSt to about 5.5 cSt, and aniline $point_{DO}$ is the aniline point of the diluent oil as measured according to ASTM D611, the aniline $point_{DO}$ being from about 95° C. to about 130° C.

Clause 7. The viscosity modifier concentrate of Clause 6, wherein the $KV100_{VMC}$ is from about 1000 cSt to about 2000 cSt.

Clause 8. The viscosity modifier concentrate of Clause 6 or Clause 7, wherein the diluent oil comprises a Group I base oil, a Group II base oil, a Group III base oil, or a combination thereof.

Clause 9. The viscosity modifier concentrate of any one of Clauses 6-8, wherein the diluent oil comprises a Group I base oil, a Group II base oil, or a combination thereof.

Clause 10. The viscosity modifier concentrate of any one of Clauses 6-9, wherein the diluent oil has one or more of the following properties:

a KV40 that is from about 15 cSt to about 31 cSt as determined according to ASTM D445;

the aniline point$_{DO}$ being from about 95° C. to about 110° C. as measured according to ASTM D611;

an aliphatic sulfur content that is from about 0 wt % to about 0.3 wt %;

a total aromatics content that is from about 0 mmol/kg to about 600 mmol/kg as measured according to ASTM D7419; or a viscosity index that is from 80 to 120 as measured according to ASTM D2270.

Clause 11. A method of forming a lubricating oil composition, comprising:

selecting a viscosity modifier for a viscosity modifier concentrate;

selecting a diluent oil to combine with the viscosity modifier based on the equation:

$$KV100_{VMC}=(130.3*KV100_{DO})-(4.5*\text{aniline point}_{DO})+532;$$

introducing the viscosity modifier to the diluent oil to form the viscosity modifier concentrate; and introducing a base oil to the viscosity modifier concentrate to form the lubricating oil composition, the base oil being the same or different than the diluent oil, wherein:

$KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline point$_{DO}$ is the aniline point of the diluent oil as measured according to ASTM D611, the aniline point$_{DO}$ being from about 95° C. to about 130° C.

Clause 12. The method of Clause 11, wherein the KV100 tvc is from about 1000 cSt to about 2000 cSt.

Clause 13. The method of Clause 11 or Clause 12, wherein the diluent oil comprises a Group I base oil, a Group II base oil, a Group III base oil, or a combination thereof.

Clause 14. The method of any one of Clauses 11-13, wherein the diluent oil has one or more of the following properties:

a KV40 that is from about 15 cSt to about 31 cSt as determined according to ASTM D445;

the aniline point$_{DO}$ being from about 95° C. to about 110° C. as measured according to ASTM D611;

an aliphatic sulfur content that is from about 0 wt % to about 0.3 wt %;

a total aromatics content that is from about 0 mmol/kg to about 600 mmol/kg as measured according to ASTM D7419; or a viscosity index that is from 80 to 120 as measured according to ASTM D2270.

Clause 15. The method of any one of Clauses 11-14, wherein the lubricating oil composition has one or more of the following properties:

a KV100 that is from about 4 cSt to about 12 cSt as measured according to ASTM D445;

a HTHS viscosity (at 150° C.) that is from about 1 mPa·s to about 4 mPa·s as measured according to ASTM D4683;

a cold cranking simulator viscosity (at −30° C.) that is from about 4,000 mPa·s to about 7,000 mPa·s; or a mini-rotary viscometer (MRV) viscosity that is from about 10,000 mPa·s to about 60,000 mPa·s as measured according to ASTM D4684.

Clause 16. A method of forming an additive package concentrate, comprising:

selecting one or more additives for the additive package concentrate;

selecting a diluent oil to combine with the one or more additives based on the equations:

$$\text{aniline point}_{DO}=105.694-(0.01507*\text{total aromatics}_{DO})-(11.21*\text{aliphatic sulfur}_{DO})+(0.15469*KV40_{DO}),\text{ and}$$

$$TOST_{DO}=4626-(10202*(\text{2+ring aromatics}_{DO}/\text{total aromatics}_{DO}))+(2065*\text{aliphatic sulfur}_{DO});\text{ and}$$

introducing the one or more additives to the diluent oil to form the additive package concentrate, wherein:

aniline point$_{DO}$ is the aniline point of the diluent oil in units of ° C., the aniline point$_{DO}$ being from about from 95° C. to 120° C., $TOST_{DO}$ is the turbine oil oxidation stability test value of the diluent oil in units of hours, the $TOST_{DO}$ being from about 1350 hours to about 3950 hours, the aliphatic sulfur$_{DO}$ is the amount (wt %) of aliphatic sulfur in the diluent oil, the $KV40_{DO}$ is the kinematic viscosity (cSt) at 40° C. of the diluent oil as measured according to ASTM D445, the total aromatics$_{DO}$ is the amount (mmol/kg) of 1+ring aromatics in the diluent oil as measured according to ASTM D7419, and the 2+ring aromatics$_{DO}$ is the amount (mmol/kg) of 2+ring aromatics in the diluent oil.

Clause 17. The method of Clause 16, wherein the diluent oil comprises a Group I base oil, a Group II base oil, a Group III base oil, or a combination thereof.

Clause 18. The method of Clause 16 or Clause 17, wherein the diluent oil comprises a Group I base oil, a Group II base oil, or a combination thereof.

Clause 19. The method of any one of Clauses 16-18, wherein the one or more additives comprises: an extreme pressure additive, an antioxidant, a solubility additive, a friction modifier, an antifoam agent, a dispersant, a detergent, a corrosion inhibitor, a rust inhibitor, a metal deactivator, an anti-wear agent, an anti-seizure agent, a wax modifier, a viscosity index improver, a viscosity modifier, a fluid-loss additive, a seal compatibility agent, a lubricity agent, an anti-staining agent, a chromophoric agent, a demulsifier, an emulsifier, a densifier, a wetting agent, a gelling agent, a tackiness agent, a colorants, or a combination thereof.

Clause 20. The method of any one of Clauses 16-19, wherein the diluent oil has one or more of the following properties:

the $KV40_{DO}$ is from about 19 cSt to about 115 cSt;

the aliphatic sulfur$_{DO}$ is from about 0.05 wt % to about 0.45 wt %;

a 2−ring aromatics content that is from about 45 mmol/kg to about 180 mmol/kg;

the 2+ring aromatics$_{DO}$ is from about 45 mmol/kg to about 255 mmol/kg; or the total aromatics$_{DO}$ is from about 340 mmol/kg to about 810 mmol/kg.

Clause 21. The method of any one of Clauses 16-20, wherein the diluent oil has a kinematic viscosity at 100° C. that is from about 3.9 cSt to about 12.5 cSt.

Clause 22. The method of any one of Clauses 16-21, wherein the diluent oil has one or more of the following properties:

a ratio of 2+ring $aromatics_{DO}$ to total $aromatics_{DO}$ that is from about 0.14 to about 0.36; or a ratio of 2−ring aromatics content to total $aromatics_{DO}$ that is from about 0.14 to about 0.23.

Clause 23. An additive package concentrate, comprising:

one or more additives; and a diluent oil, the diluent oil characterized by the equations:

$$\text{aniline point}_{DO}=105.694-(0.01507*\text{total aromatics}_{DO})-(11.21*\text{aliphatic sulfur}_{DO})+(0.15469*KV40_{DO}),\text{ and}$$

$$TOST_{DO}=4626-(10202*(2+\text{ring aromatics}_{DO}/\text{total aromatics}_{DO}))+(2065*\text{aliphatic sulfur}_{DO}),$$

wherein:

aniline $point_{DO}$ is the aniline point of the diluent oil in units of ° C., the aniline $point_{DO}$ being from about from 95° C. to 120° C., $TOST_{DO}$ is the turbine oil oxidation stability test value of the diluent oil in units of hours, the $TOST_{DO}$ being from about 1350 hours to about 3950 hours, the aliphatic $sulfur_{DO}$ is the amount (wt %) of aliphatic sulfur in the diluent oil, the $KV40_{DO}$ is the kinematic viscosity (cSt) at 40° C. of the diluent oil as measured according to ASTM D445, the total $aromatics_{DO}$ is the amount (mmol/kg) of 1+ring aromatics in the diluent oil as measured according to ASTM D7419, and the 2+ring $aromatics_{DO}$ is the amount (mmol/kg) of 2+ring aromatics in the diluent oil.

Clause 24. The additive package concentrate of Clause 23, wherein the diluent oil comprises a Group I base oil, a Group II base oil, a Group III base oil, or a combination thereof.

Clause 25. The additive package concentrate of Clause 23 or Clause 24, wherein the one or more additives comprises: an extreme pressure additive, an antioxidant, a solubility additive, a friction modifier, an antifoam agent, a dispersant, a detergent, a corrosion inhibitor, a rust inhibitor, a metal deactivator, an anti-wear agent, an anti-seizure agent, a wax modifier, a viscosity index improver, a viscosity modifier, a fluid-loss additive, a seal compatibility agent, a lubricity agent, an anti-staining agent, a chromophoric agent, a demulsifier, an emulsifier, a densifier, a wetting agent, a gelling agent, a tackiness agent, a colorants, or a combination thereof.

Clause 26. The additive package concentrate of any one of Clauses 23-25, wherein the diluent oil has one or more of the following properties:

the $KV40_{DO}$ is from about 19 cSt to about 115 cSt;

the aliphatic $sulfur_{DO}$ is from about 0.05 wt % to about 0.45 wt %;

a kinematic viscosity at 100° C. that is from about 3.9 cSt to about 12.5 cSt;

a 2−ring aromatics content that is from about 45 mmol/kg to about 180 mmol/kg;

the 2+ring $aromatics_{DO}$ is from about 45 mmol/kg to about 255 mmol/kg; or the total $aromatics_{DO}$ is from about 340 mmol/kg to about 810 mmol/kg.

Clause 27. The additive package concentrate of any one of Clauses 23-26, wherein the diluent oil has one or more of the following properties:

a ratio of 2+ring $aromatics_{DO}$ to total $aromatics_{DO}$ that is from about 0.14 to about 0.36; or a ratio of 2−ring aromatics content to total $aromatics_{DO}$ that is from about 0.14 to about 0.23.

Clause 28. A method of forming a lubricating oil composition, comprising:

selecting one or more additives for an additive package concentrate;

selecting a diluent oil to combine with the one or more additives based on the equations:

$$\text{aniline point}_{DO}=105.694-(0.01507*\text{total aromatics}_{DO})-(11.21*\text{aliphatic sulfur}_{DO})+(0.15469*KV40_{DO}),\text{ and}$$

$$TOST_{DO}=4626-(10202*(2+\text{ring aromatics}_{DO}/\text{total aromatics}_{DO}))+(2065*\text{aliphatic sulfur}_{DO});\text{ and}$$

introducing the one or more additives to the diluent oil to form the additive package concentrate; and introducing a base oil to the additive package concentrate to form the lubricating oil composition, the base oil being the same or different than the diluent oil, wherein:

aniline $point_{DO}$ is the aniline point of the diluent oil in units of ° C., the aniline $point_{DO}$ being from about from 95° C. to 120° C., $TOST_{DO}$ is the turbine oil oxidation stability test value of the diluent oil in units of hours, the $TOST_{DO}$ being from about 1350 hours to about 3950 hours, the aliphatic $sulfur_{DO}$ is the amount (wt %) of aliphatic sulfur in the diluent oil, the $KV40_{DO}$ is the kinematic viscosity (cSt) at 40° C. of the diluent oil as measured according to ASTM D445, the total $aromatics_{DO}$ is the amount (mmol/kg) of 1+ring aromatics in the diluent oil as measured according to ASTM D7419, and the 2+ring $aromatics_{DO}$ is the amount (mmol/kg) of 2+ring aromatics in the diluent oil.

Clause 29. The method of Clause 28, wherein the diluent oil comprises a Group I base oil, a Group II base oil, a Group III base oil, or a combination thereof.

Clause 30. The method of Clause 28 or Clause 29, wherein the diluent oil has one or more of the following properties:

the $KV40_{DO}$ is from about 19 cSt to about 115 cSt;

the aliphatic $sulfur_{DO}$ is from about 0.05 wt % to about 0.45 wt %;

a kinematic viscosity at 100° C. that is from about 3.9 cSt to about 12.5 cSt;

a 2−ring aromatics content that is from about 45 mmol/kg to about 180 mmol/kg;

the 2+ring $aromatics_{DO}$ is from about 45 mmol/kg to about 255 mmol/kg; or the total $aromatics_{DO}$ is from about 340 mmol/kg to about 810 mmol/kg.

Clause 31. The method of any one of Clauses 28-30, wherein the diluent oil has one or more of the following properties:

a ratio of 2+ring $aromatics_{DO}$ to total $aromatics_{DO}$ that is from about 0.14 to about 0.36; or a ratio of 2−ring aromatics content to total $aromatics_{DO}$ that is from about 0.14 to about 0.23.

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

What is claimed is:

1. A method of forming a viscosity modifier concentrate comprising:

selecting a viscosity modifier for the viscosity modifier concentrate;

selecting a diluent oil to combine with the viscosity modifier based on the equation:

$$KV100_{VMC}=(130.3*KV100_{DO})-(4.5*\text{aniline point}_{DO})+532;\text{ and}$$

introducing the viscosity modifier to the diluent oil to form the viscosity modifier concentrate, wherein:

$KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline $point_{DO}$ is the aniline point of the diluent oil as measured according to ASTM D611, the aniline $point_{DO}$ being from about 95° C. to about 130° C.

2. The method of claim 1, wherein the $KV100_{VMC}$ is from about 1000 cSt to about 2000 cSt.

3. The method of claim 1, wherein the diluent oil comprises a Group I base oil, a Group II base oil, a Group III base oil, or a combination thereof.

4. The method of claim 1, wherein the diluent oil comprises a Group I base oil, a Group II base oil, or a combination thereof.

5. The method of claim 1, wherein the diluent oil has one or more of the following properties:

a KV40 that is from about 15 cSt to about 31 cSt as determined according to ASTM D445;

the aniline $point_{DO}$ being from about 95° C. to about 110° C. as measured according to ASTM D611;

an aliphatic sulfur content that is from about 0 wt % to about 0.3 wt %;

a total aromatics content that is from about 0 mmol/kg to about 600 mmol/kg as measured according to ASTM D7419; or a viscosity index that is from 80 to 120 as measured according to ASTM D2270.

6. A viscosity modifier concentrate comprising:

a viscosity modifier; and a diluent oil, the diluent oil characterized by the equation:

$$KV100_{VMC}=(130.3*KV100_{DO})-(4.5*\text{aniline point}_{DO})+532,$$

wherein:

$KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline $point_{DO}$ is the aniline point of the diluent oil as measured according to ASTM D611, the aniline $point_{DO}$ being from about 95° C. to about 130° C.

7. The viscosity modifier concentrate of claim 6, wherein the $KV100_{VMC}$ is from about 1000 cSt to about 2000 cSt.

8. The viscosity modifier concentrate of claim 6, wherein the diluent oil comprises a Group I base oil, a Group II base oil, a Group III base oil, or a combination thereof.

9. The viscosity modifier concentrate of claim 6, wherein the diluent oil comprises a Group I base oil, a Group II base oil, or a combination thereof.

10. The viscosity modifier concentrate of claim 6, wherein the diluent oil has one or more of the following properties:

a KV40 that is from about 15 cSt to about 31 cSt as determined according to ASTM D445;

the aniline $point_{DO}$ being from about 95° C. to about 110° C. as measured according to ASTM D611;

an aliphatic sulfur content that is from about 0 wt % to about 0.3 wt %;

a total aromatics content that is from about 0 mmol/kg to about 600 mmol/kg as measured according to ASTM D7419; or a viscosity index that is from 80 to 120 as measured according to ASTM D2270.

11. A method of forming a lubricating oil composition comprising:

selecting a viscosity modifier for a viscosity modifier concentrate;

selecting a diluent oil to combine with the viscosity modifier based on the equation:

$$KV100_{VMC}=(130.3*KV100_{DO})-(4.5*\text{aniline point}_{DO})+532;$$

introducing the viscosity modifier to the diluent oil to form the viscosity modifier concentrate; and introducing a base oil to the viscosity modifier concentrate to form the lubricating oil composition, the base oil being the same or different than the diluent oil, wherein:

$KV100_{VMC}$ is the kinematic viscosity at 100° C. of the viscosity modifier concentrate in units of cSt, the $KV100_{VMC}$ being from about 400 cSt to about 2500 cSt, $KV100_{DO}$ is the kinematic viscosity at 100° C. of the diluent oil as measured according to ASTM D445, the $KV100_{DO}$ being from about 3.9 cSt to about 5.5 cSt, and aniline $point_{DO}$ is the aniline point of the diluent oil as measured according to ASTM D611, the aniline $point_{DO}$ being from about 95° C. to about 130° C.

12. The method of claim 11, wherein the $KV100_{VMC}$ is from about 1000 cSt to about 2000 cSt.

13. The method of claim 11, wherein the diluent oil comprises a Group I base oil, a Group II base oil, a Group III base oil, or a combination thereof.

14. The method of claim 11, wherein the diluent oil has one or more of the following properties:

a KV40 that is from about 15 cSt to about 31 cSt as determined according to ASTM D445;

the aniline $point_{DO}$ being from about 95° C. to about 110° C. as measured according to ASTM D611;

an aliphatic sulfur content that is from about 0 wt % to about 0.3 wt %;

a total aromatics content that is from about 0 mmol/kg to about 600 mmol/kg as measured according to ASTM D7419; or a viscosity index that is from 80 to 120 as measured according to ASTM D2270.

15. The method of claim 11, wherein the lubricating oil composition has one or more of the following properties:

a KV100 that is from about 4 cSt to about 12 cSt as measured according to ASTM D445;

a HTHS viscosity (at 150° C.) that is from about 1 mPa·s to about 4 mPa·s as measured according to ASTM D4683;

a cold cranking simulator viscosity (at −30° C.) that is from about 4,000 mPa·s to about 7,000 mPa·s; or a mini-rotary viscometer (MRV) viscosity that is from about 10,000 mPa·s to about 60,000 mPa·s as measured according to ASTM D4684.

16. A method of forming an additive package concentrate comprising:

selecting one or more additives for the additive package concentrate;

selecting a diluent oil to combine with the one or more additives based on the equations:

$$\text{aniline point}_{DO}=105.694-(0.01507*\text{total aromatics}_{DO})-(11.21*\text{aliphatic sulfur}_{DO})+(0.15469*KV40_{DO}),\text{ and}$$

$$TOST_{DO}=4626-(10202*(2\text{+ring aromatics}_{DO}/\text{total aromatics}_{DO}))+(2065*\text{aliphatic sulfur}_{DO});\text{ and}$$

introducing the one or more additives to the diluent oil to form the additive package concentrate, wherein:

aniline $point_{DO}$ is the aniline point of the diluent oil in units of ° C., the aniline $point_{DO}$ being from about from 95° C. to 120° C., $TOST_{DO}$ is the turbine oil oxidation stability test value of the diluent oil in units of hours, the $TOST_{DO}$ being from about 1350 hours to about 3950 hours, the aliphatic $sulfur_{DO}$ is the amount (wt %) of aliphatic sulfur in the diluent oil, the $KV40_{DO}$ is the kinematic viscosity (cSt) at 40° C. of the diluent oil as measured according to ASTM D445, the total $aromatics_{DO}$ is the amount (mmol/kg) of 1+ring aromatics in the diluent oil as measured according to ASTM D7419, and the 2+ring $aromatics_{DO}$ is the amount (mmol/kg) of 2+ring aromatics in the diluent oil.

17. The method of claim 16, wherein the diluent oil comprises a Group I base oil, a Group II base oil, a Group III base oil, or a combination thereof.

18. The method of claim 16, wherein the diluent oil comprises a Group I base oil, a Group II base oil, or a combination thereof.

19. The method of claim 16, wherein the one or more additives comprises: an extreme pressure additive, an antioxidant, a solubility additive, a friction modifier, an antifoam agent, a dispersant, a detergent, a corrosion inhibitor, a rust inhibitor, a metal deactivator, an anti-wear agent, an anti-seizure agent, a wax modifier, a viscosity index improver, a viscosity modifier, a fluid-loss additive, a seal compatibility agent, a lubricity agent, an anti-staining agent, a chromophoric agent, a demulsifier, an emulsifier, a densifier, a wetting agent, a gelling agent, a tackiness agent, a colorants, or a combination thereof.

20. The method of claim 16, wherein the diluent oil has one or more of the following properties:

the $KV40_{DO}$ is from about 19 cSt to about 115 cSt;

the aliphatic $sulfur_{DO}$ is from about 0.05 wt % to about 0.45 wt %;

a 2−ring aromatics content that is from about 45 mmol/kg to about 180 mmol/kg;

the 2+ring $aromatics_{DO}$ is from about 45 mmol/kg to about 255 mmol/kg; or the total $aromatics_{DO}$ is from about 340 mmol/kg to about 810 mmol/kg.

21. The method of claim 16, wherein the diluent oil has a kinematic viscosity at 100° C. that is from about 3.9 cSt to about 12.5 cSt.

22. The method of claim 16, wherein the diluent oil has one or more of the following properties:

a ratio of 2+ring $aromatics_{DO}$ to total $aromatics_{DO}$ that is from about 0.14 to about 0.36; or a ratio of 2−ring aromatics content to total $aromatic_{DO}$ that is from about 0.14 to about 0.23.

23. An additive package concentrate comprising:

one or more additives; and a diluent oil, the diluent oil characterized by the equations:

$$\text{aniline point}_{DO}=105.694-(0.01507*\text{total aromatics}_{DO})-(11.21*\text{aliphatic sulfur}_{DO})+(0.15469*KV40_{DO}),\text{ and}$$

$$TOST_{DO}=4626-(10202*(2\text{+ring aromatics}_{DO}/\text{total aromatics}_{DO}))+(2065*\text{aliphatic sulfur}_{DO}),$$

wherein:

aniline $point_{DO}$ is the aniline point of the diluent oil in units of ° C., the aniline $point_{DO}$ being from about from 95° C. to 120° C., $TOST_{DO}$ is the turbine oil oxidation stability test value of the diluent oil in units of hours, the $TOST_{DO}$ being from about 1350 hours to about 3950 hours, the aliphatic $sulfur_{DO}$ is the amount (wt %) of aliphatic sulfur in the diluent oil, the $KV40_{DO}$ is the kinematic viscosity (cSt) at 40° C. of the diluent oil as measured according to ASTM D445, the total $aromatics_{DO}$ is the amount (mmol/kg) of 1+ring aromatics in the diluent oil as measured according to ASTM D7419, and the 2+ring $aromatics_{DO}$ is the amount (mmol/kg) of 2+ring aromatics in the diluent oil.

24. The additive package concentrate of claim 23, wherein the diluent oil comprises a Group I base oil, a Group II base oil, a Group III base oil, or a combination thereof.

25. The additive package concentrate of claim 23, wherein the one or more additives comprises: an extreme pressure additive, an antioxidant, a solubility additive, a friction modifier, an antifoam agent, a dispersant, a detergent, a corrosion inhibitor, a rust inhibitor, a metal deactivator, an anti-wear agent, an anti-seizure agent, a wax modifier, a viscosity index improver, a viscosity modifier, a fluid-loss additive, a seal compatibility agent, a lubricity agent, an anti-staining agent, a chromophoric agent, a demulsifier, an emulsifier, a densifier, a wetting agent, a gelling agent, a tackiness agent, a colorants, or a combination thereof.

26. The additive package concentrate of claim 23, wherein the diluent oil has one or more of the following properties:

the $KV40_{DO}$ is from about 19 cSt to about 115 cSt;

the aliphatic $sulfur_{DO}$ is from about 0.05 wt % to about 0.45 wt %;

a kinematic viscosity at 100° C. that is from about 3.9 cSt to about 12.5 cSt;

a 2–ring aromatics content that is from about 45 mmol/kg to about 180 mmol/kg;

the 2+ring $aromatics_{DO}$ is from about 45 mmol/kg to about 255 mmol/kg; or the total $aromatics_{DO}$ is from about 340 mmol/kg to about 810 mmol/kg.

27. The additive package concentrate of claim 23, wherein the diluent oil has one or more of the following properties:

a ratio of 2+ring $aromatics_{DO}$ to total $aromatics_{DO}$ that is from about 0.14 to about 0.36; or a ratio of 2–ring aromatics content to total $aromatics_{DO}$ that is from about 0.14 to about 0.23.

28. A method of forming a lubricating oil composition comprising:

selecting one or more additives for an additive package concentrate;

selecting a diluent oil to combine with the one or more additives based on the equations:

$$\text{aniline point}_{DO}=105.694-(0.01507*\text{total aromatics}_{DO})-(11.21*\text{aliphatic sulfur}_{DO})+(0.15469*KV40_{DO}),\text{ and}$$

$$TOST_{DO}=4626-(10202*(2+\text{ring aromatics}_{DO}/\text{total aromatics}_{DO}))+(2065*\text{aliphatic sulfur}_{DO});\text{ and}$$

introducing the one or more additives to the diluent oil to form the additive package concentrate; and introducing a base oil to the additive package concentrate to form the lubricating oil composition, the base oil being the same or different than the diluent oil, wherein:

aniline $point_{DO}$ is the aniline point of the diluent oil in units of ° C., the aniline $point_{DO}$ being from about from 95° C. to 120° C., $TOST_{DO}$ is the turbine oil oxidation stability test value of the diluent oil in units of hours, the $TOST_{DO}$ being from about 1350 hours to about 3950 hours, the aliphatic $sulfur_{DO}$ is the amount (wt %) of aliphatic sulfur in the diluent oil, the $KV40_{DO}$ is the kinematic viscosity (cSt) at 40° C. of the diluent oil as measured according to ASTM D445, the total $aromatics_{DO}$ is the amount (mmol/kg) of 1+ring aromatics in the diluent oil as measured according to ASTM D7419, and the 2+ring $aromatics_{DO}$ is the amount (mmol/kg) of 2+ring aromatics in the diluent oil.

29. The method of claim 28, wherein the diluent oil comprises a Group I base oil, a Group II base oil, a Group III base oil, or a combination thereof.

30. The method of claim 28, wherein the diluent oil has one or more of the following properties:

the $KV40_{DO}$ is from about 19 cSt to about 115 cSt;

the aliphatic $sulfur_{DO}$ is from about 0.05 wt % to about 0.45 wt %;

a kinematic viscosity at 100° C. that is from about 3.9 cSt to about 12.5 cSt;

a 2–ring aromatics content that is from about 45 mmol/kg to about 180 mmol/kg;

the 2+ring $aromatics_{DO}$ is from about 45 mmol/kg to about 255 mmol/kg; or the total $aromatics_{DO}$ is from about 340 mmol/kg to about 810 mmol/kg.

31. The method of claim 28, wherein the diluent oil has one or more of the following properties:

a ratio of 2+ring $aromatics_{DO}$ to total $aromatics_{DO}$ that is from about 0.14 to about 0.36; or a ratio of 2–ring aromatics content to total $aromatics_{DO}$ that is from about 0.14 to about 0.23.

* * * * *